US011605341B2

(12) United States Patent
Huangfu et al.

(10) Patent No.: US 11,605,341 B2
(45) Date of Patent: Mar. 14, 2023

(54) PIXEL CIRCUIT, PIXEL DRIVING METHOD AND DISPLAY DEVICE

(71) Applicant: BOE Technology Group Co., Ltd., Beijing (CN)

(72) Inventors: Lujiang Huangfu, Beijing (CN); Tian Dong, Beijing (CN); Libin Liu, Beijing (CN); Xinshe Yin, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/424,478

(22) PCT Filed: Jan. 5, 2021

(86) PCT No.: PCT/CN2021/070263
§ 371 (c)(1),
(2) Date: Jul. 20, 2021

(87) PCT Pub. No.: WO2021/139645
PCT Pub. Date: Jul. 15, 2021

(65) Prior Publication Data

US 2022/0101788 A1 Mar. 31, 2022

(30) Foreign Application Priority Data

Jan. 6, 2020 (CN) ..... 202010009126.0

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01);
(Continued)

(58) Field of Classification Search
CPC .. G09G 3/3233; G09G 3/3266; G09G 3/3291; G09G 2310/0278; G09G 2310/061; G09G 2320/0233
See application file for complete search history.

(56) References Cited

U.S. PATENT DOCUMENTS 5,949,270 A 9/1999 Saito
6,246,180 B1 6/2001 Nishigaki
(Continued)

FOREIGN PATENT DOCUMENTS

CN 102708793 A 10/2012
CN 102881253 A 1/2013
(Continued)

OTHER PUBLICATIONS

CN 2020100091260 first office action.
PCT/CN2021/070263 international search report and written opinion.

*Primary Examiner* — Kenneth B Lee, Jr.
(74) *Attorney, Agent, or Firm* — IPro, PLLC

(57) ABSTRACT

The present disclosure provides a pixel circuit, a pixel driving method and a display device. The pixel circuit includes a driving circuit, an energy storage circuit and a switch control circuit. A first end of the energy storage circuit is coupled to a control end of the driving circuit, a second end of the energy storage circuit is coupled to a first end of the driving circuit via the switch control circuit, and the energy storage circuit is configured to store a voltage. The switch control circuit is configured to control the second end of the energy storage circuit to be electrically coupled to a voltage application end or the first end of the driving circuit under the control of a light-emission control signal from a light-emission control line. The driving circuit is
(Continued)

configured to generate a driving current in accordance with a voltage between the control end and first end of the driving circuit.

19 Claims, 21 Drawing Sheets

(52) U.S. Cl.
CPC ..... *G09G 2310/0278* (2013.01); *G09G 2310/061* (2013.01); *G09G 2320/0233* (2013.01)

(56) References Cited

U.S. PATENT DOCUMENTS

| | | | |
|---|---|---|---|
| 7,414,599 | B2 | 8/2008 | Chung et al. |
| 7,675,018 | B2 | 3/2010 | Jang et al. |
| 9,208,717 | B2 | 12/2015 | Kimura et al. |
| 2012/0139957 | A1 | 6/2012 | Choi |
| 2016/0035276 | A1 | 2/2016 | Yin et al. |
| 2016/0267843 | A1 | 9/2016 | Wang et al. |
| 2018/0005569 | A1 | 1/2018 | Li |
| 2019/0371238 | A1 | 12/2019 | Gao et al. |
| 2020/0090586 | A1* | 3/2020 | He ..... G09G 3/3275 |
| 2021/0097931 | A1 | 4/2021 | Yue et al. |
| 2021/0233469 | A1 | 7/2021 | Chen et al. |
| 2021/0407401 | A1* | 12/2021 | Chen ..... G09G 3/3233 |

FOREIGN PATENT DOCUMENTS

| | | | |
|---|---|---|---|
| CN | 102903333 | A | 1/2013 |
| CN | 103218972 | A | 7/2013 |
| CN | 203882588 | U | 10/2014 |
| CN | 104700780 | A | 6/2015 |
| CN | 105206221 | B | 6/2018 |
| CN | 108492780 | A | 9/2018 |
| CN | 108492785 | A | 9/2018 |
| CN | 108520719 | A | 9/2018 |
| CN | 108735155 | A | 11/2018 |
| CN | 109887466 | A | 6/2019 |
| CN | 110047440 | A | 7/2019 |
| CN | 110648630 | A | 1/2020 |
| EP | 3242287 | A1 | 11/2017 |

* cited by examiner

PIXEL CIRCUIT, PIXEL DRIVING METHOD AND DISPLAY DEVICE

CROSS-REFERENCE TO RELATED APPLICATION

This application is the U.S. national phase of PCT Application No. PCT/CN2021/070263 filed on Jan. 5, 2021, which claims a priority of Chinese patent application No. 202010009126.0 filed on Jan. 6, 2020, which is incorporated herein by reference in its entirety.

TECHNICAL FIELD

The present disclosure relates to the field of display technology, in particular to a pixel circuit, a pixel driving method and a display device.

BACKGROUND

In an Active-Matrix Organic Light-Emitting Diode (AMOLED) pixel circuit, a driving transistor in a driving circuit is coupled to a power source voltage end via a light-emission control transistor, a first end of a storage capacitor is coupled to a gate electrode of the driving transistor, and a second end of the storage capacitor is coupled to a source electrode of the driving transistor. At a light-emission stage of a display period, a voltage applied between the gate electrode and the source electrode of the driving transistor is affected by a drain-to-source voltage of the light-emission control transistor, so it is impossible to accurately apply a voltage signal maintained in the storage capacitor to between the gate electrode and the source electrode of the driving transistor of the driving circuit. At this time, a gate-to-source voltage of the driving transistor is non-uniform due to the non-uniform drain-to-source voltage, leading to such a defect as display non-uniformity.

SUMMARY

In one aspect, the present disclosure provides in some embodiments a pixel circuit, including a driving circuit, an energy storage circuit and a switch control circuit. A first end of the energy storage circuit is coupled to a control end of the driving circuit, a second end of the energy storage circuit is coupled to a first end of the driving circuit via the switch control circuit, and the energy storage circuit is configured to store a voltage. The switch control circuit is configured to control the second end of the energy storage circuit to be electrically coupled to a voltage application end or the first end of the driving circuit under the control of a light-emission control signal from a light-emission control line. The driving circuit is configured to generate a driving current in accordance with a voltage between the control end and the first end of the driving circuit.

In a possible embodiment of the present disclosure, the pixel circuit further includes a light-emitting element. A driving transistor of the driving circuit is a p-type transistor, the first end of the driving circuit is coupled to a power source voltage end, and the voltage application end is the power-source voltage end; or the driving transistor is an n-type transistor, the first end of the driving circuit is coupled to a first electrode of the light-emitting element, a second electrode of the light-emitting element is coupled to a first voltage end, and the voltage application end is an end coupled to the first electrode of the light-emitting element.

In a possible embodiment of the present disclosure, the switch control circuit is further configured to control a reference voltage end to be electrically coupled to the second end of the energy storage circuit under the control of a resetting signal from a resetting line or a scanning signal from a scanning line, and the reference voltage end is configured to provide a reference voltage.

In a possible embodiment of the present disclosure, the switch control circuit includes a switch control transistor, a control electrode of which is coupled to the light-emission control line, a first electrode of which is coupled to the second end of the energy storage circuit, and a second electrode of which is coupled to the first end of the driving circuit.

In a possible embodiment of the present disclosure, the switch control circuit further includes a resetting transistor and a voltage control transistor. A control electrode of the resetting transistor is coupled to the resetting line, a first electrode of the resetting transistor is coupled to the reference voltage end, and a second electrode of the resetting transistor is coupled to the second end of the energy storage circuit. A control electrode of the voltage control transistor is coupled to the scanning line, a first electrode of the voltage control transistor is coupled to the reference voltage end, and a second electrode of the voltage control transistor is coupled to the second end of the energy storage circuit.

In a possible embodiment of the present disclosure, the pixel circuit further includes an initialization circuit configured to write an initialization voltage from an initialization voltage end into the first end of the energy storage circuit under the control of the resetting signal from the resetting line.

In a possible embodiment of the present disclosure, the initialization circuit includes an initialization transistor, a control electrode of which is coupled to the resetting line, a first electrode of which is coupled to the first end of the energy storage circuit, and a second electrode of which is coupled to the initialization voltage end.

In a possible embodiment of the present disclosure, the pixel circuit further includes a compensation control circuit configured to control the control end of the driving circuit to be electrically coupled to the second end of the driving circuit under the control of the scanning signal from the scanning line.

In a possible embodiment of the present disclosure, the compensation control circuit includes a compensation control transistor, a control electrode of which is coupled to the scanning line, a first electrode of which is coupled to the control end of the driving circuit, and a second electrode of which is coupled to the second end of the driving circuit.

In a possible embodiment of the present disclosure, the pixel circuit further includes a light-emitting element, a first light-emission control circuit and a second light-emission control circuit. The second end of the energy storage circuit is coupled to the first end of the driving circuit via the switch control circuit, the first light-emission control circuit is configured to control the first end of the driving circuit to be electrically coupled to a power source voltage end under the control the light-emission control signal, the second end of the driving circuit is coupled to the light-emitting element via the second light-emission control circuit, and the second light-emission control circuit is configured to control the second end of the driving circuit to be electrically coupled to the light-emitting element under the control of the light-emission control signal.

In a possible embodiment of the present disclosure, the voltage application end is a power source voltage end, and the pixel circuit further includes a light-emitting element, a first light-emission control circuit and a second light-emission control circuit. A second end of the energy storage circuit is coupled to the power source voltage end via the switch control circuit, the first light-emission control circuit is configured to control the first end of the driving circuit to be electrically coupled to the power source voltage end under the control of the light-emission control signal, the second end of the driving circuit is coupled to the light-emitting element via the second light-emission control circuit, and the second light-emission control circuit is configured to control the second end of the driving circuit to be electrically coupled to the light-emitting element under the control of the light-emission control signal.

In a possible embodiment of the present disclosure, the driving circuit includes a driving transistor, the first light-emission control circuit includes a first light-emission control transistor, the second light-emission control circuit includes a second light-emission control transistor, and the energy storage circuit includes a storage capacitor. A control electrode of the driving transistor is the control end of the driving circuit, a first electrode of the driving transistor is the first end of the driving circuit, and a second electrode of the driving transistor is the second end of the driving circuit. A first end of the storage capacitor is the first end of the energy storage circuit, and a second end of the storage capacitor is the second end of the energy storage circuit. A control electrode of the first light-emission control transistor is coupled to the light-emission control line, a first electrode of the first light-emission control transistor is coupled to the first electrode of the driving transistor, and a second electrode of the first light-emission control transistor is coupled to the power source voltage end. A control electrode of the second light-emission control transistor is coupled to the light-emission control line, a first electrode of the second light-emission control transistor is coupled to the light-emitting element, and a second electrode of the second light-emission control transistor is coupled to the second electrode of the driving transistor.

In a possible embodiment of the present disclosure, the pixel circuit further includes a light-emitting element, a first light-emission control circuit and a second light-emission control circuit. The second end of the energy storage circuit is coupled to the first end of the driving circuit via the switch control circuit, the first end of the driving circuit is coupled to the light-emitting element via the first light-emission control circuit, the first light-emission control circuit is configured to control the first end of the driving circuit to be electrically coupled to the light-emitting element under the control the light-emission control signal, and the second light-emission control circuit is configured to control the second end of the driving circuit to be electrically coupled to the power source voltage end under the control of the light-emission control signal.

In a possible embodiment of the present disclosure, the pixel circuit further includes a light-emitting element, a first light-emission control circuit and a second light-emission control circuit. The voltage application end is an end coupled to a first electrode of the light-emitting element, the second end of the energy storage circuit is coupled to the voltage application end via the switch control circuit, a second electrode of the light-emitting element is coupled to a first voltage end, the first end of the driving circuit is coupled to the light-emitting element via the first light-emission control circuit, the first light-emission control circuit is configured to control the first end of the driving circuit to be electrically coupled to the light-emitting element under the control of the light-emission control signal, and the second light-emission control circuit is configured to control the second end of the driving circuit to be electrically coupled to the power source voltage end under the control of the light-emission control signal.

In a possible embodiment of the present disclosure, the driving circuit includes a driving transistor, the first light-emission control circuit includes a first light-emission control transistor, the second light-emission control circuit includes a second light-emission control transistor, and the energy storage circuit includes a storage capacitor. A control electrode of the driving transistor is the control end of the driving circuit, a first electrode of the driving transistor is the first end of the driving circuit, and a second electrode of the driving transistor is the second end of the driving circuit. A first end of the storage capacitor is the first end of the energy storage circuit, and a second end of the storage capacitor is the second end of the energy storage circuit. A control electrode of the first light-emission control transistor is coupled to the light-emission control line, a first electrode of the first light-emission control transistor is coupled to the first electrode of the driving transistor, and a second electrode of the first light-emission control transistor is coupled to the light-emitting element. A control electrode of the second light-emission control transistor is coupled to the light-emission control line, a first electrode of the second light-emission control transistor is coupled to the power source voltage end, and a second electrode of the second light-emission control transistor is coupled to the second electrode of the driving transistor.

In a possible embodiment of the present disclosure, the pixel circuit further includes a data write-in circuit configured to write a data voltage across a data line into the first end of the driving circuit under the control of the scanning signal from the scanning line.

In a possible embodiment of the present disclosure, the data write-in circuit includes a data write-in transistor, a control electrode of which is coupled to the scanning line, a first electrode of which is coupled to the data line, and a second electrode of which is coupled to the first end of the driving circuit.

In another aspect, the present disclosure provides in some embodiments a pixel driving method for the above-mentioned pixel circuit. A display period includes a light-emission stage, and the pixel driving method includes, at the light-emission stage, controlling, by the switch control circuit, the second end of the energy storage circuit to be electrically coupled to the voltage application end or the first end of the driving circuit under the control of the light-emission control signal from the light-emission control line.

In a possible embodiment of the present disclosure, the display period includes an initialization stage and a data write-in stage before the light-emission stage. The pixel driving method further includes: at the initialization stage, controlling, by the switch control circuit, the reference voltage end to be electrically coupled to the second end of the energy storage circuit under the control of the resetting signal from the resetting line; and at the data write-in stage, controlling, by the switch control circuit, the reference voltage end to be electrically coupled to the second end of the energy storage circuit under the control of the scanning signal from the scanning line.

In a possible embodiment of the present disclosure, the display period includes an initialization stage and a data write-in stage before the light-emission stage, and the pixel driving method further includes, at the initialization stage and the data write-in stage, controlling, by the switch control circuit, the second end of the energy storage circuit to be electrically decoupled from the voltage application end or the first end of the driving circuit under the control of the light-emission control signal from the light-emission control line.

In yet another aspect, the present disclosure provides in some embodiments a display device including the above-mentioned pixel circuit.

DETAILED DESCRIPTION

Figure 1:
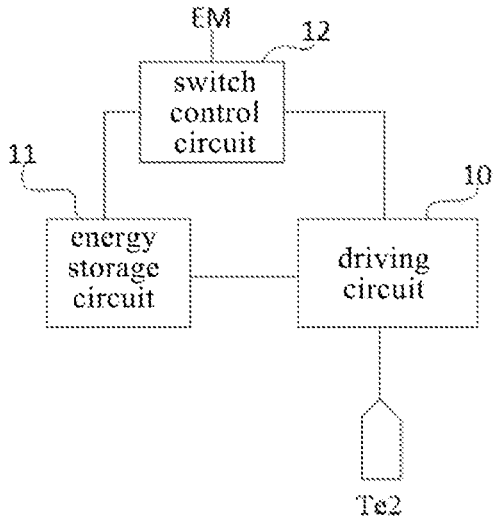
FIG. 1 is a schematic view showing a pixel circuit according to one embodiment of the present disclosure.

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

All transistors adopted in the embodiments of the present disclosure may be triodes, thin film transistors (TFT), field effect transistors (FETs) or any other elements having an identical characteristic. In order to differentiate two electrodes other than a control electrode from each other, one of the two electrodes is called as first electrode and the other is called as second electrode.

In actual use, when the transistor is a triode, the control electrode is a base, the first electrode is a collector and the second electrode is an emitter, or the control electrode is a base, the first electrode is an emitter and the second electrode is a collector.

In actual use, when the transistor is a TFT or FET, the control electrode is a gate electrode, the first electrode is a drain electrode and the second electrode is a source electrode, or the control electrode is a gate electrode, the first electrode is a source electrode and the second electrode is a drain electrode.

The present disclosure provides in some embodiments a pixel circuit, which includes a driving circuit, an energy storage circuit and a switch control circuit. A first end of the energy storage circuit is coupled to a control end of the driving circuit, a second end of the energy storage circuit is coupled to a first end of the driving circuit via the switch control circuit, and the energy storage circuit is configured to store a voltage. The switch control circuit is configured to control the second end of the energy storage circuit to be electrically coupled to a voltage application end or the first end of the driving circuit under the control of a light-emission control signal from a light-emission control line. The driving circuit is configured to generate a driving current in accordance with a voltage between the control end and the first end of the driving circuit.

During the implementation, the driving current is used to drive a light-emitting element to emit light. The driving current flows from the first end of the driving circuit to the second end of the driving circuit, or flows from the second end of the driving circuit to the first end of the driving circuit.

During the operation of the pixel circuit in the embodiments of the present disclosure, a display period includes a light-emission stage. At the light-emission stage, the switch control circuit is configured to control the second end of the energy storage circuit to be electrically coupled to voltage application end or the first end of the driving circuit under the control of the light-emission control signal from the light-emission control line, so as to prevent the generation of an additional voltage between the control end and the first end of the driving circuit at the light-emission stage. As a result, it is able to apply a voltage signal maintained in the energy storage circuit to between a gate electrode and a source electrode of a driving transistor of the driving circuit, prevent a gate-to-source voltage of the driving transistor from being adversely affected by a drain-to-source voltage of a light-emission control transistor, and prevent the occurrence of a non-uniform gate-to-source voltage of the driving transistor due to the non-uniform drain-to-source voltage, thereby to prevent the occurrence of such a defect as display non-uniformity.

In the embodiments of the present disclosure, when the driving transistor of the driving circuit is a p-type transistor, the first end of the driving circuit is directly coupled to a power source voltage end, and the second end of the driving circuit is coupled to the light-emitting element. The voltage application end is just the power source voltage end.

In the embodiments of the present disclosure, when the driving transistor of the driving circuit is an n-type transistor, the first end of the driving circuit is directly coupled to a first electrode of the light-emitting element, the second end of the driving circuit is coupled to the power source voltage end, and the voltage application end is an end coupled to the first electrode of the light-emitting element. At this time, a second electrode of the light-emitting element is coupled to a first voltage end.

To be specific, the first voltage end is, but not limited to, a ground end, a low voltage end or cathode voltage end.

During the implementation, the pixel circuit in the embodiments further includes a light-emitting element. When the driving transistor of the driving circuit is a p-type transistor, the first end of the driving circuit is coupled to the power source voltage end via a first light-emission control circuit, and the second end of the driving circuit is coupled to the light-emitting element via a second light-emission control circuit. At this time, the voltage application end is the power source voltage end.

During the implementation, the pixel circuit in the embodiments of the present disclosure further includes a light-emitting element. When the driving transistor of the driving circuit is an n-type transistor, the first end of the driving circuit is coupled to a first electrode of the light-emitting element via the first light-emission control circuit, and the second end of the driving circuit is coupled to the power source voltage end via the second light-emission control circuit. At this time, the voltage application end is an end coupled to the first electrode of the light-emitting element, and a second electrode of the light-emitting element is coupled to the first voltage end.

During the implementation, the light-emitting element is an Organic Light-Emitting Diode (OLED), the first electrode of the light-emitting element is an anode of the OLED, and the second electrode of the light-emitting element is a cathode of the OLED. However, the light-emitting element is not limited thereto.

As shown in FIG. 1, the pixel circuit in the embodiments of the present disclosure includes a driving circuit 10, an energy storage circuit 11 and a switch control circuit 12. A first end of the energy storage circuit 11 is coupled to a control end of the driving circuit 10, a second end of the energy storage circuit 11 is coupled to a first end of the driving circuit 10 via the switch control circuit 12, and the energy storage circuit 11 is configured to store a voltage. The switch control circuit 12 is coupled to a light-emission control line EM, the second end of the energy storage circuit 11 and the first end of the driving circuit 10, and configured to control the second end of the energy storage circuit 11 to be electrically coupled to the first end of the driving circuit 10 under the control of a light-emission control signal from the light-emission control line EM. The driving circuit 10 is configured to generate a driving current in accordance with a voltage between the control end and the first end of the driving circuit 10. The driving current is used to drive a light-emitting element (not shown in FIG. 1) to emit light. The driving current flows from the first end of the driving circuit 10 to a second end Te2 of the driving circuit 10, or flows from the second end Te2 of the driving circuit 10 to the first end of the driving circuit 10.

During the operation of the pixel circuit in FIG. 1, at a light-emission stage, the switch control circuit 12 controls the second end of the energy storage circuit 11 to be electrically coupled to the first end of the driving circuit 10 under the control of the light-emission control signal from the light-emission control line EM, so as to prevent the generation an additional voltage between the control end and the first end of the driving circuit at the light-emission stage. As a result, it is able to apply a voltage signal maintained in the energy storage circuit 11 to between a gate electrode and a source electrode of a driving transistor of the driving circuit 10, prevent a gate-to-source voltage of the driving transistor from being adversely affected by a drain-to-source voltage of a light-emission control transistor, and prevent the occurrence of a non-uniform gate-to-source voltage of the driving transistor due to the non-uniform drain-to-source voltage, thereby to prevent the occurrence of such a defect as display non-uniformity. During the implementation, the display period further includes an initialization stage and a data write-in stage before the light-emission stage.

At the initialization stage and the data write-in stage, the switch control circuit controls the second end of the energy storage circuit to be electrically decoupled from the first end of the driving circuit under the control of the light-emission control signal from the light-emission control line.

During the implementation, the switch control circuit is further configured to control a reference voltage end to be electrically coupled to the second end of the energy storage circuit under the control of a resetting signal from a resetting line or a scanning signal from a scanning line, and the reference voltage end is configured to provide a reference voltage.

In the embodiments of the present disclosure, a voltage value of the reference voltage is, but not limited to, constant at the initialization stage and the data write-in stage.

Figure 2A:
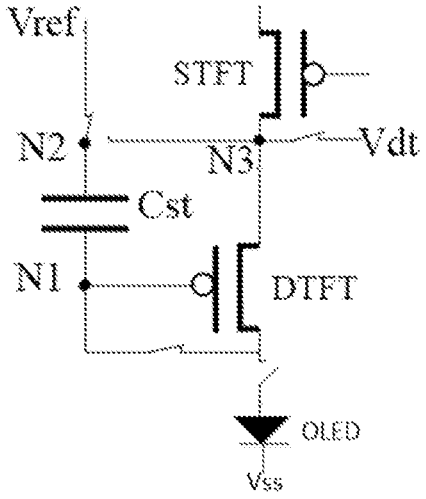
FIG. 2A is a schematic view showing a connection relationship among a first node N1, a second node N2 and a third node N3 in the pixel circuit at a data write-in stage when a driving transistor of a driving circuit is a p-type transistor according to one embodiment of the present disclosure.
Figure 2B:
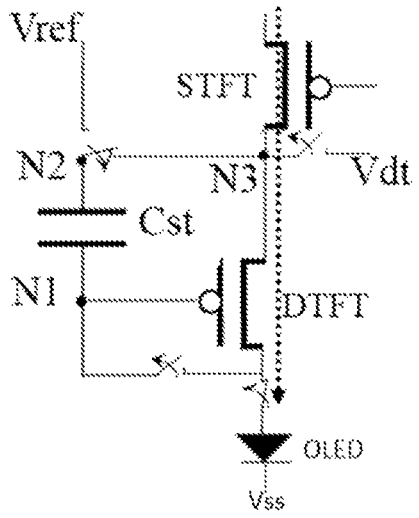
FIG. 2B is a schematic view showing a connection relationship among the first node N1, the second node N2 and the third node N3 in the pixel circuit at a light-emission stage when the driving transistor of the driving circuit is the p-type transistor according to one embodiment of the present disclosure.

In the embodiments of the present disclosure, the second end of the energy storage circuit is a reference voltage end, and the first end of the energy storage circuit is a signal end. At the initialization stage and the data write-in stage, the switch control circuit controls a potential at the second end of the energy storage circuit to be the reference voltage. In this way, it is able to provide a signal written by the first end of the energy storage circuit with a stable voltage value, thereby to initialize a potential at the control end of the driving circuit at the initialization stage and accurately write a data voltage into the control end of the driving circuit at the data write-in stage. During the implementation, the driving circuit includes a driving transistor, and the energy storage circuit includes a storage capacitor. The pixel circuit in the embodiments of the present disclosure further includes a light-emission control transistor. As shown in FIGS. 2A and 2B, the pixel circuit includes an OLED, a driving transistor DTFT, a light-emission control transistor STFT, and a storage capacitor Cst. The driving transistor DTFT is a p-type transistor, N1 is a first node coupled to a gate electrode of DTFT, N2 is a second node coupled to a second end of Cst, and N3 is a third node coupled to a source electrode of DTFT.

As shown in FIG. 2A, at the data write-in stage, N1 receives a reference voltage Vref, N1 is coupled to the gate electrode of DTFT, and a drain electrode of DTFT is electrically decoupled from an anode of OLED. A data voltage Vdt across the data line is written into N3, and N2 is not electrically coupled to N3.

As shown in FIG. 2B, at the light-emission stage, N1 is electrically decoupled from the drain electrode of DTFT, the drain electrode of DTFT is electrically coupled to the anode of OLED, the data line is electrically decoupled from N3, N2 is electrically coupled to N3, and STFT and DTFT are turned on.

A cathode of OLED receives a cathode voltage Vss.

Figure 3A:
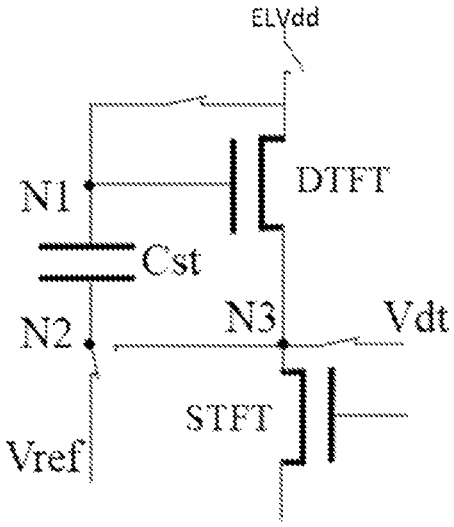
FIG. 3A is a schematic view showing a connection relationship among the first node N1, the second node N2 and the third node N3 in the pixel circuit at the data write-in stage when the driving transistor of the driving circuit is an n-type transistor according to one embodiment of the present disclosure.
Figure 3B:
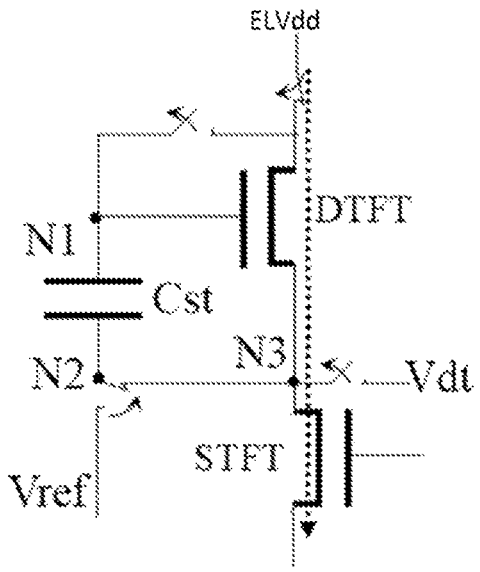
FIG. 3B is a schematic view showing a connection relationship among the first node N1, the second node N2 and the third node N3 in the pixel circuit at the light-emission stage when the driving transistor of the driving circuit is the n-type transistor according to one embodiment of the present disclosure.

As shown in FIGS. 3A and 3B, the pixel circuit in the embodiments of the present disclosure includes an OLED, a driving transistor DTFT, a light-emission control transistor STFT and a storage capacitor Cst. The driving transistor DTFT is an n-type transistor, N1 is a first node coupled to a gate electrode of DTFT, N2 is a second node coupled to a second end of Cst, and N3 is a third node coupled to a source electrode of DTFT.

As shown in FIG. 3A, at the data write-in stage, N2 receives a reference voltage Vref, N1 is coupled to the gate electrode of DTFT, a drain electrode of DTFT is electrically decoupled from a power source voltage end ELVdd for providing the power source voltage Vdd, a data voltage Vdt across the data line is written into N3, and N2 is electrically decoupled from N3.

As shown in FIG. 3B, at the light-emission stage, N1 is electrically decoupled from the drain electrode of DTFT, the drain electrode of DTFT is electrically coupled to the power source voltage end, the data line is electrically decoupled from N3, N2 is electrically coupled to N3, and STFT and DTFT are turned on.

As shown in FIGS. 2A, 2B, 3A and 3B, Vss represents a cathode voltage.

In the embodiments of the present disclosure, N2 is a signal maintenance capacitor reference end.

During the operation of the pixel circuit in the embodiments of the present disclosure, at a stage other than the light-emission stage, N2 is initialized using a separate reference voltage Vref. Through the separate reference voltage Vref, it is able to prevent the occurrence of signal deviation caused when a potential distribution of the power source voltage and the cathode voltage as well as a change in the potential are adversely affected by an IR drop (which is a phenomenon in an integrated circuit where voltages of a power source and a ground network decreases or increases).

In addition, during the operation of the pixel circuit in the embodiments of the present disclosure, at the light-emission stage, N2 is electrically coupled to N3, and N3 is coupled to the source electrode of DTFT, so the gate-to-source voltage DTFT is irrelevant to a drain-to-source voltage Vds of STFT. In this way, it is able to prevent the generation an additional voltage between N2 and N3, and apply a voltage signal maintained in Cst to between the gate electrode and the source electrode of DTFT. When DTFT drives OLED to emit light, the voltage between N2 and N3 is not affected by the drain-to-source voltage Vds of STFT, thereby it is able to prevent the occurrence of display non-uniformity.

To be specific, the switch control circuit includes a switch control transistor, a control electrode of which is coupled to the light-emission control line, a first electrode of which is coupled to the second end of the energy storage circuit, and a second electrode of which is coupled to the first end of the driving circuit.

To be specific, the switch control circuit further includes a resetting transistor and a voltage control transistor. A control electrode of the resetting transistor is coupled to the resetting line, a first electrode of the resetting transistor is coupled to the reference voltage end, and a second electrode of the resetting transistor is coupled to the second end of the energy storage circuit. A control electrode of the voltage control transistor is coupled to the scanning line, a first electrode of the voltage control transistor is coupled to the reference voltage end, and a second electrode of the voltage control transistor is coupled to the second end of the energy storage circuit.

During the implementation, the pixel circuit further includes an initialization circuit configured to write a reference voltage from the reference voltage end into the second end of the energy storage circuit under the control of the scanning signal or the resetting signal from the resetting line, and write an initialization voltage from an initialization voltage end into the first end of the energy storage circuit under the control of the resetting signal.

Figure 3C:
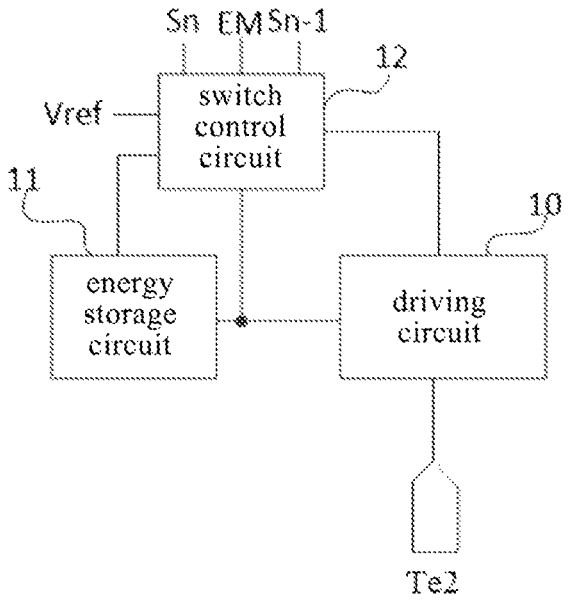
FIG. 3C is another schematic view showing the pixel circuit according to one embodiment of the present disclosure.

As shown in FIG. 3C, on the basis of the pixel circuit in FIG. 1, the switch control circuit 12 is further coupled to a resetting line Sn−1, a scanning line Sn and a reference voltage end, and configured to control the reference voltage end to be electrically coupled to the second end of the energy storage circuit 11 under the control of a resetting signal from the resetting line Sn−1 or a scanning signal from the scanning line Sn. The reference voltage end is configured to provide a reference voltage Vref.

During the operation of the pixel circuit in FIG. 3C, the display period further includes an initialization stage and a data write-in stage before the light-emission stage. At the initialization stage, the switch control circuit 12 controls the reference voltage end to be electrically coupled to the second end of the energy storage circuit 11 under the control of the resetting signal. At the data write-in stage, the switch control circuit 12 controls the reference voltage end to be electrically coupled to the second end of the energy storage circuit 11 under the control of the scanning signal.

During the operation of the pixel circuit in FIG. 3C, a reference potential is applied to the second end of the energy storage circuit 11 through the separate reference voltage Vref rather than through the power source voltage Vdd or the cathode voltage Vss, so it is able to prevent the occurrence of voltage deviation for the power source voltage and the cathode voltage caused by the IR drop.

In the related art, Vdd or Vss also serves as a reference potential. Considering a difference in the driving currents for images at different brightness values, the distribution of Vdd and Vss on a back plate changes due to the IR drop, so the signal reception and setting accuracy are adversely affected, and thereby the display uniformity is adversely affected when an image is displayed.

Figure 4:
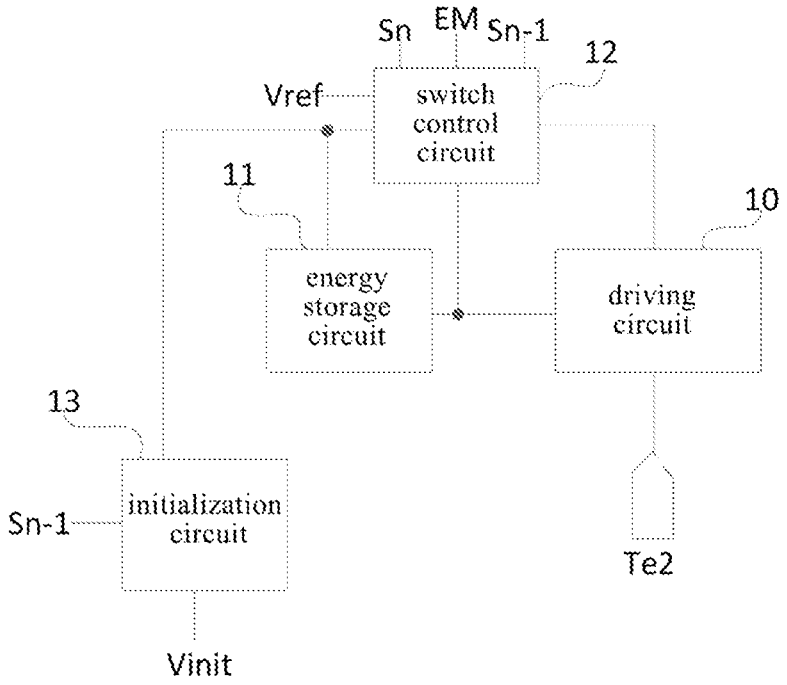
FIG. 4 is yet another schematic view showing the pixel circuit according to one embodiment of the present disclosure.

As shown in FIG. 4, on the basis of the pixel circuit in FIG. 3C, the pixel circuit in the embodiments of the present disclosure further includes an initialization circuit 13. The initialization circuit 13 is coupled to the resetting line Sn−1, an initialization voltage end and the first end of the energy storage circuit 11, and configured to write an initialization voltage Vinit from the initialization voltage end into the first end of the energy storage circuit 11 under the control of the resetting signal.

During the operation of the pixel circuit in FIG. 4, at the initialization stage, the initialization circuit 13 writes Vinit into the first end of the energy storage circuit 11 under the control of the resetting signal, so as to turn on the driving transistor of the driving circuit at the beginning of the data write-in stage.

To be specific, the initialization circuit includes an initialization transistor, a control electrode of which is coupled to the resetting line, a first electrode of which is coupled to the first end of the energy storage circuit, and a second electrode of which is coupled to the initialization voltage end.

In a possible embodiment of the present disclosure, the pixel circuit further includes a compensation control circuit configured to control the control end of the driving circuit to be electrically coupled to the second end of the driving circuit under the control of the scanning signal from the scanning line.

According to the pixel circuit in the embodiments of the present disclosure, through the compensation control circuit, it is able to prevent a display brightness value of the light-emitting element from being adversely affected by a threshold voltage of the driving transistor of the driving circuit.

Figure 5:
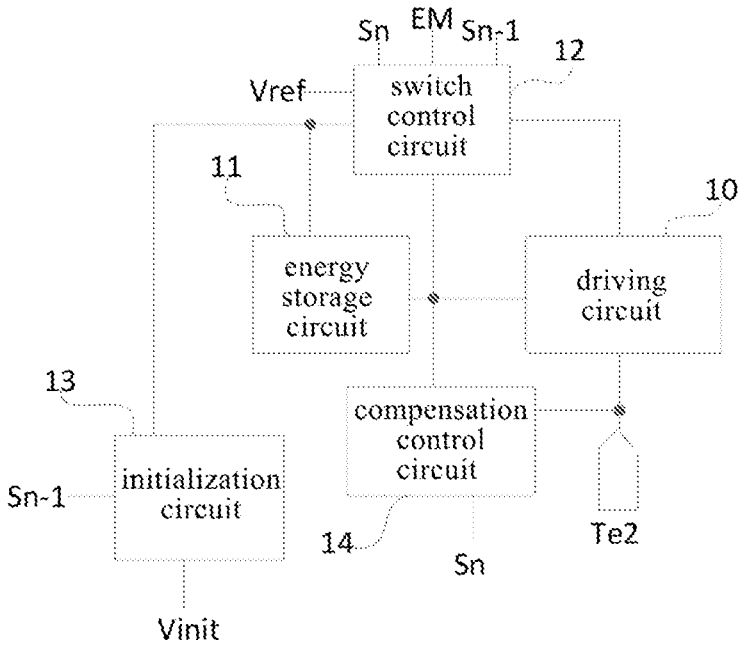
FIG. 5 is still yet another schematic view showing the pixel circuit according to one embodiment of the present disclosure.

As shown in FIG. 5, on the basis of the pixel circuit in FIG. 4, the pixel circuit in the embodiments of the present disclosure further includes a compensation control circuit 14 coupled to the scanning line Sn, the control end of the driving circuit 10 and the second end of the driving circuit 10, and configured to control the control end of the driving circuit 10 to be electrically coupled to the second end of the driving circuit 10 under the control of the scanning signal from the scanning line Sn.

During the operation of the pixel circuit in FIG. 5, at the data write-in stage, the compensation control circuit 14 controls the control end of the driving circuit 10 to be electrically coupled to the second end of the driving circuit 10 under the control of the scanning signal, so that a potential at the control end of the driving circuit 10 is relevant to the threshold voltage of the driving transistor of the driving circuit 10. As a result, at the light-emission stage, the driving current generated by the driving transistor for driving the light-emitting element is irrelevant to the threshold voltage.

To be specific, the compensation control circuit includes a compensation control transistor, a control electrode of which is coupled to the scanning line, a first electrode of which is coupled to the control end of the driving circuit, and a second electrode of which is coupled to the second end of the driving circuit.

In a possible embodiment of the present disclosure, the pixel circuit in the embodiments of the present disclosure further includes a light-emitting element, a first light-emission control circuit and a second light-emission control circuit. The first light-emission control circuit is configured to control the first end of the driving circuit to be electrically coupled to the power source voltage end under the control of the light-emission control signal, the second end of the driving circuit is coupled to the light-emitting element via the second light-emission control circuit, and the second light-emission control circuit is configured to control the second end of the driving circuit to be electrically coupled to the light-emitting element under the control of the light-emission control signal.

During the implementation, the pixel circuit in the embodiments of the present disclosure further includes the first light-emission control circuit and the second light-emission control circuit. At the light-emission stage, the first light-emission control circuit controls the first end of the driving circuit to be electrically coupled to the power source voltage end under the control of the light-emission control signal, and the second light-emission control circuit controls the second end of the driving circuit to be electrically coupled to the light-emitting element under the control of the light-emission control signal, so that the driving circuit drives the light-emitting element to emit light.

Figure 6A:
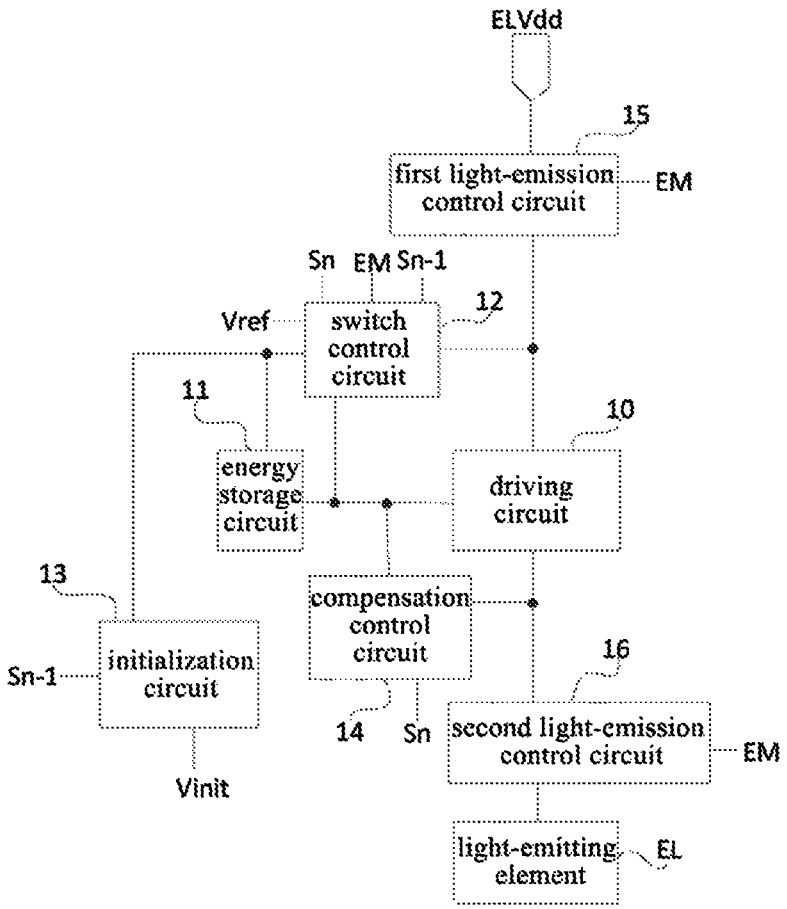
FIG. 6A is still yet another schematic view showing the pixel circuit according to one embodiment of the present disclosure.

As shown in FIG. 6A, on the basis of the pixel circuit in FIG. 5, the pixel circuit in the embodiments of the present disclosure further includes a light-emitting element EL, a first light-emission control circuit 15 and a second light-emission control circuit 16. The first light-emission control circuit 15 is coupled to the light-emission control line EM, the first end of the driving circuit 10 and the power source voltage end ELVdd, and configured to control the first end of the driving circuit 10 to be electrically coupled to the power source voltage end ELVdd under the control of the light-emission control signal from the light-emission control line EM. The power source voltage end ELVdd is configured to provide a power source voltage Vdd. The second end of the driving circuit 10 is coupled to the light-emitting element EL via the second light-emission control circuit 16. The second light-emission control circuit 16 is coupled to the light-emission control line EM, the second end of the driving circuit 10 and the light-emitting element EL, and configured to control the second end of the driving circuit 10 to be electrically coupled to the light-emitting element EL under the control of the light-emission control signal.

In the pixel circuit in FIG. 6A, the driving transistor of the driving circuit 10 is, but not limited to, a p-type transistor.

Figure 6B:
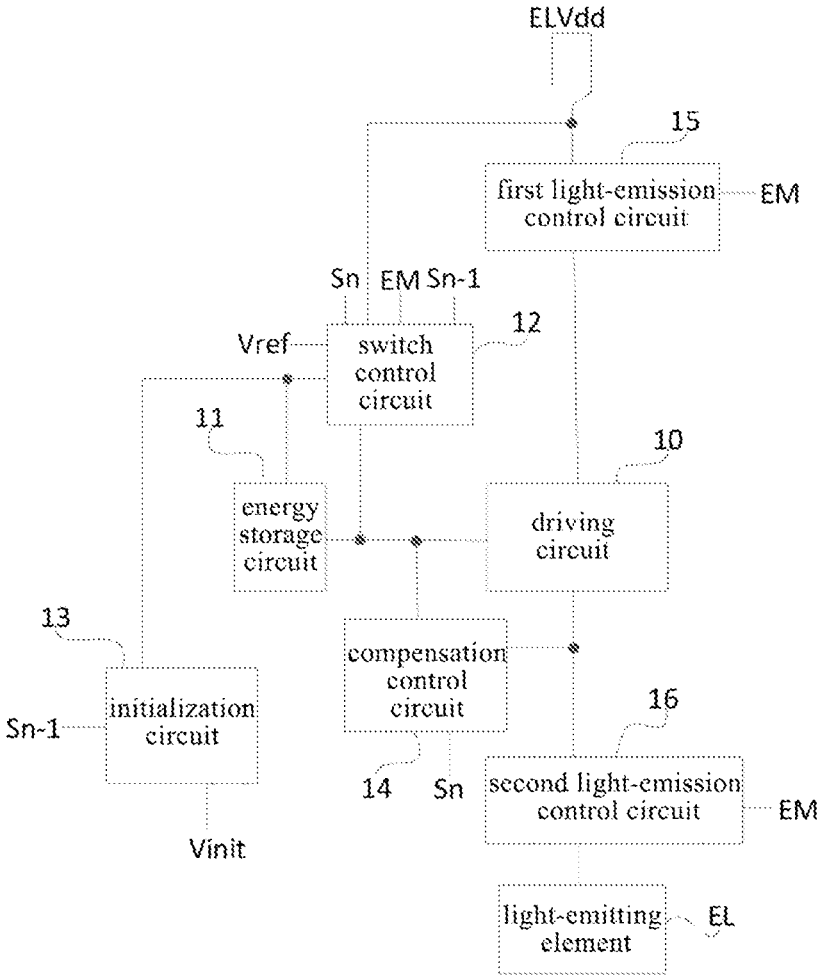
FIG. 6B is still yet another schematic view showing the pixel circuit according to one embodiment of the present disclosure.

A circuit structure of the pixel circuit in FIG. 6B differs from that in FIG. 6A merely in that the second end of the energy storage circuit 11 is coupled to the power source voltage end ELVdd via the switch control circuit 12.

In the pixel circuit in FIG. 6B, the second end of the energy storage circuit 11 is coupled to the voltage application end via the switch control circuit 12, and the voltage application end is the power source voltage end ELVdd.

The switch control circuit 12 is configured to, at the light-emission stage, control the second end of the energy storage circuit 11 to be electrically coupled to the power source voltage end ELVdd under the control of the light-emission control signal from the light-emission control line EM. At the light-emission stage, the first light-emission control circuit 15 is configured to control the first end of the driving circuit 10 to be electrically coupled to the power source voltage end ELVdd under the control of the light-emission control signal from the light-emission control line EM, so that the second end of the energy storage circuit 11 is electrically coupled to the first end of the driving circuit 10.

The switch control circuit 12 is further configured to, at the initialization stage and the data write-in stage, control the second end of the energy storage circuit 11 to be electrically decoupled from the power source voltage end ELVdd under the control of the light-emission control signal.

To be specific, the driving circuit includes a driving transistor, the first light-emission control circuit includes a first light-emission control transistor, the second light-emission control circuit includes a second light-emission control transistor, and the energy storage circuit includes a storage capacitor. A control electrode of the driving transistor is the control end of the driving circuit, a first electrode of the driving transistor is the first end of the driving circuit, and a second electrode of the driving transistor is the second end of the driving circuit. A first end of the storage capacitor is the first end of the energy storage circuit, and a second end of the storage capacitor is the second end of the energy storage circuit. A control electrode of the first light-emission control transistor is coupled to the light-emission control line, a first electrode of the first light-emission control transistor is coupled to the power source voltage end, and a second electrode of the first light-emission control transistor is coupled to the first electrode of the driving transistor. A control electrode of the second light-emission control transistor is coupled to the light-emission control line, a first electrode of the second light-emission control transistor is coupled to the second electrode of the driving transistor, and a second electrode of the second light-emission control transistor is coupled to the light-emitting element.

In another possible embodiment of the present disclosure, the pixel circuit further includes a light-emitting element, a first light-emission control circuit and a second light-emission control circuit. The second end of the driving circuit is coupled to the light-emitting element via the first light-emission control circuit, the first light-emission control circuit is configured to control the first end of the driving circuit to be electrically coupled to the light-emitting element under the control of the light-emission control signal, and the second light-emission control circuit is configured to control the second end of the driving circuit to be electrically coupled to the power source voltage end under the control of the light-emission control signal.

During the implementation, the pixel circuit in the embodiments of the present disclosure further includes the first light-emission control circuit and the second light-emission control circuit. At the light-emission stage, the first light-emission control circuit controls the first end of the driving circuit to be electrically coupled to the light-emitting element under the control of the light-emission control signal, and the second light-emission control circuit controls the second end of the driving circuit to be electrically coupled to the power source voltage end under the control of the light-emission control signal, so that the driving circuit drives the light-emitting element to emit light.

Figure 7A:
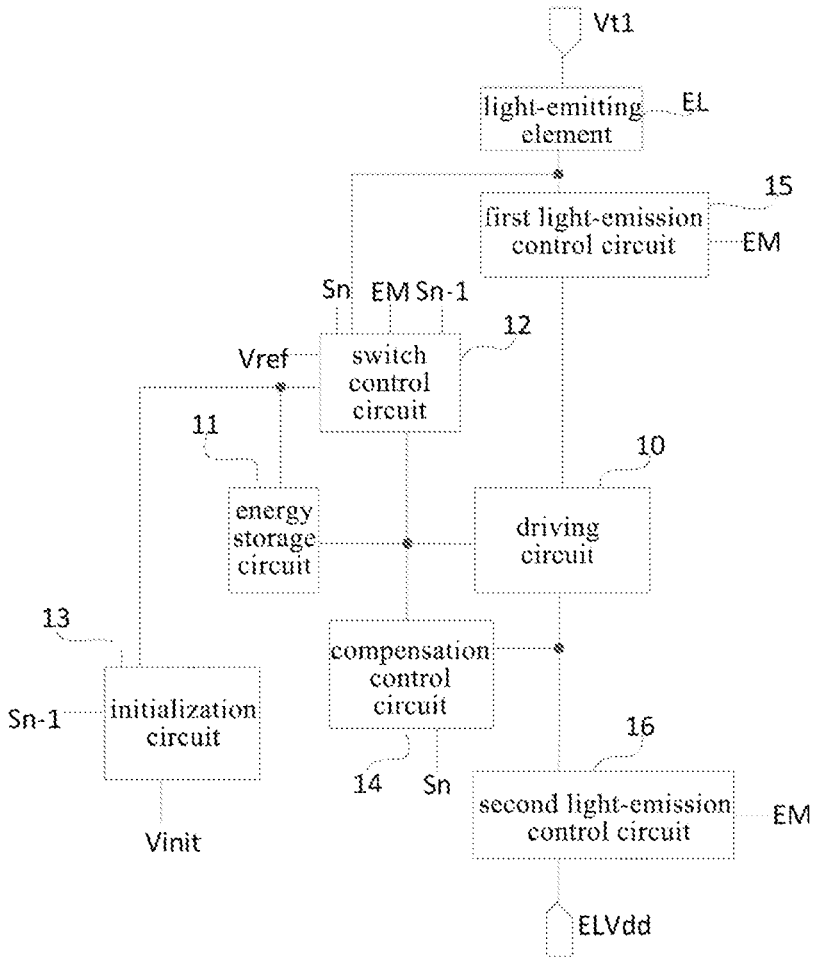
FIG. 7A is still yet another schematic view showing the pixel circuit according to one embodiment of the present disclosure.

As shown in FIG. 7A, on the basis of the pixel circuit in FIG. 5, the pixel circuit in the embodiments of the present disclosure further includes a light-emitting element EL, a first light-emission control circuit 15 and a second light-emission control circuit 16. The first end of the driving circuit 10 is coupled to a first electrode of the light-emitting element EL via the first light-emission control circuit 15, and a second electrode of the light-emitting element EL is coupled to a first voltage end Vt1. The first light-emission control circuit 15 is coupled to the light-emission control line EM, the first end of the driving circuit 10 and the first electrode of the light-emitting element EL, and configured to control the first end of the driving circuit 10 to be electrically coupled to the first electrode of the light-emitting element EL under the control of the light-emission control signal from the light-emission control line EM. The second light-emission control circuit 16 is coupled to the light-emission control line EM, the second end of the driving circuit 10 and the power source voltage end ELVdd, and configured to control the second end of the driving circuit 10 to be electrically coupled to the power source voltage end ELVdd under the control of the light-emission control signal. The power source voltage end ELVdd is configured to provide a power source voltage Vdd.

During the implementation, the first voltage end is, but not limited to, a ground end, a low voltage end or a cathode voltage end.

In FIG. 7A, the driving transistor of the driving circuit 10 is, but not limited to, an n-type transistor.

Figure 7B:
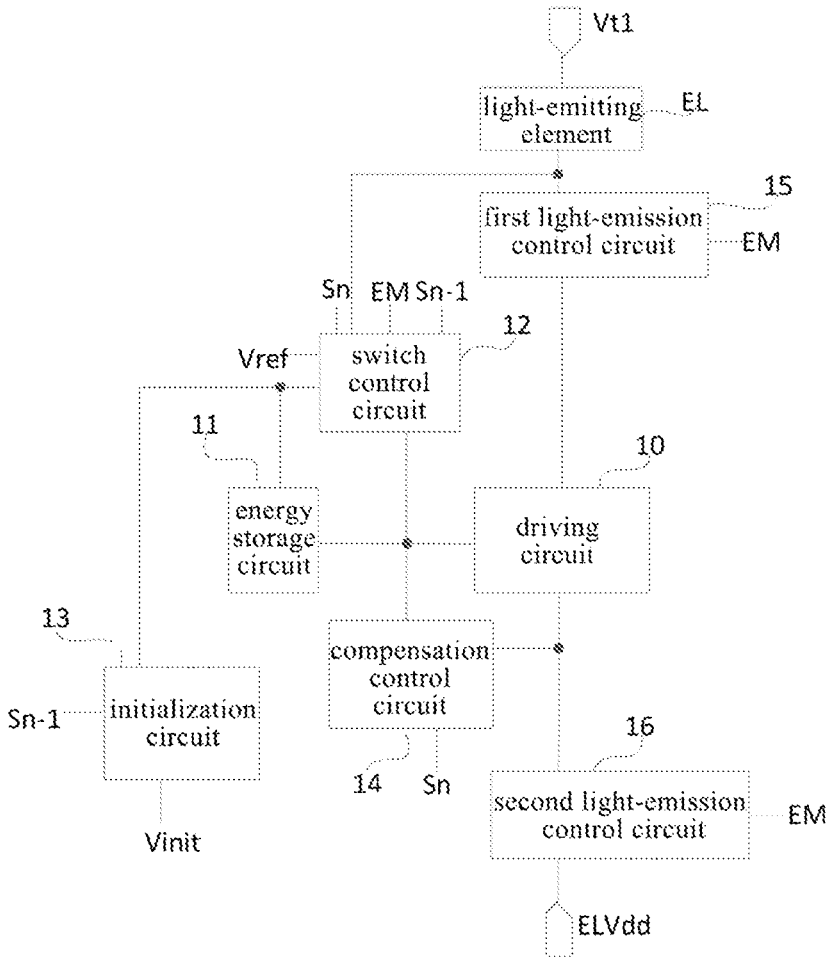
FIG. 7B is still yet another schematic view showing the pixel circuit according to one embodiment of the present disclosure.

A circuit structure of the pixel circuit in FIG. 7B differs from that in FIG. 7A merely in that the second end of the energy storage circuit 11 is coupled to the first electrode of the light-emitting element EL via the switch control circuit 12.

In the pixel circuit in FIG. 7B, the second end of the energy storage circuit 11 is coupled to the voltage application end via the switch control circuit 12, and the voltage application end is an end coupled to the first electrode of the light-emitting element EL.

The switch control circuit 12 is configured to, at the light-emission stage, control the second end of the energy storage circuit 11 to be electrically coupled to the first electrode of the light-emitting element EL under the control of the light-emission control signal from the light-emission control line EM. At the light-emission stage, the first light-emission control circuit 15 is configured to control the first end of the driving circuit 10 to be electrically coupled to the first electrode of the light-emitting element EL under the control of the light-emission control signal from the light-emission control line EM, so that the second end of the energy storage circuit 11 is electrically coupled to the first end of the driving circuit 10.

The switch control circuit 12 is further configured to, at the initialization stage and the data write-in stage, control the second end of the energy storage circuit 11 to be electrically decoupled from the first electrode of the light-emitting element EL under the control of the light-emission control signal.

To be specific, the driving circuit includes a driving transistor, the first light-emission control circuit includes a first light-emission control transistor, the second light-emission control circuit includes a second light-emission control transistor, and the energy storage circuit includes a storage capacitor. A control electrode of the driving transistor is the control end of the driving circuit, a first electrode of the driving transistor is the first end of the driving circuit, and a second electrode of the driving transistor is the second end of the driving circuit. A first end of the storage capacitor is the first end of the energy storage circuit, and a second end of the storage capacitor is the second end of the energy storage circuit. A control electrode of the first light-emission control transistor is coupled to the light-emission control line, a first electrode of the first light-emission control transistor is coupled to the light-emitting element, and a second electrode of the first light-emission control transistor is coupled to the first electrode of the driving transistor. A control electrode of the second light-emission control transistor is coupled to the light-emission control line, a first electrode of the second light-emission control transistor is coupled to the second electrode of the driving transistor, and a second electrode of the second light-emission control transistor is coupled to the power source voltage end.

During the implementation, the pixel circuit in the embodiments of the present disclosure further includes a data write-in circuit configured to write a data voltage across a data line into the first end of the driving circuit under the control of the scanning signal from the scanning line.

The pixel circuit in the embodiments of the present disclosure further includes the data write-in circuit. At the data write-in stage, the data write-in circuit writes the data voltage into the first end of the driving circuit under the control of the scanning signal, so that the driving circuit drives the light-emitting element to emit light in accordance with the data voltage at the light-emission stage.

Figure 8A:
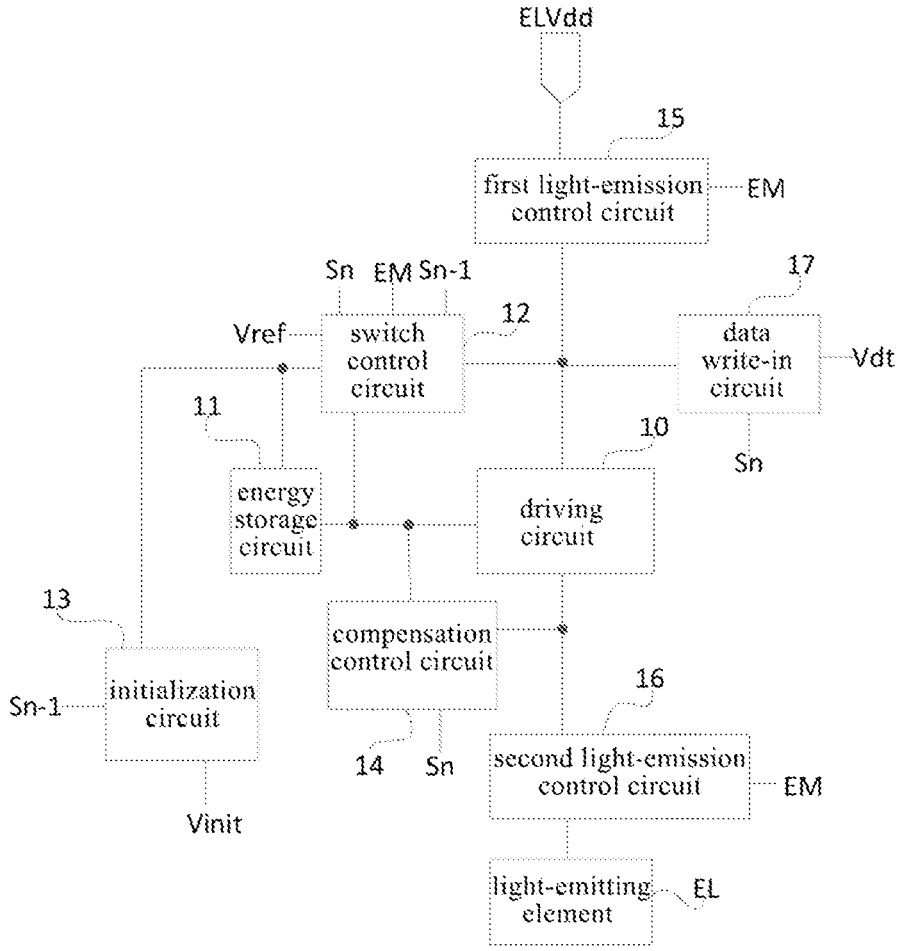
FIG. 8A is still yet another schematic view showing the pixel circuit according to one embodiment of the present disclosure.

As shown in FIG. 8A, on the basis of the pixel circuit in FIG. 6A, the pixel circuit in the embodiments of the present disclosure further includes a data write-in circuit 17 coupled to the scanning line Sn, the data line and the first end of the driving circuit 10, and configured to write the data voltage Vdt across the data line into the first end of the driving circuit 10 under the control of the scanning signal from the scanning line Sn.

At the light-emission stage, the data write-in circuit 17 writes Vdt into the first end of the driving circuit 10 under the control of the scanning signal.

Figure 8B:
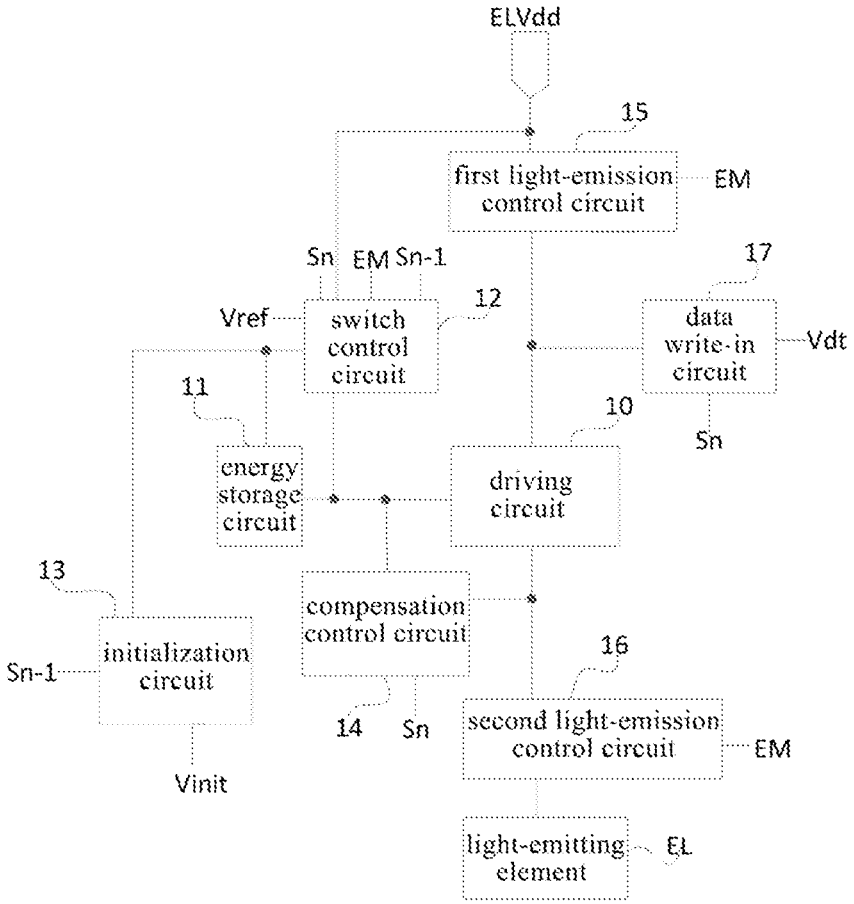
FIG. 8B is still yet another schematic view showing the pixel circuit according to one embodiment of the present disclosure.

As shown in FIG. 8B, on the basis of the pixel circuit in FIG. 6B, the pixel circuit in the embodiments of the present disclosure further includes a data write-in circuit 17 coupled to the scanning line Sn, the data line and the first end of the driving circuit 10, and configured to write the data voltage Vdt across the data line into the first end of the driving circuit 10 under the control of the scanning signal from the scanning line Sn.

At the light-emission stage, the data write-in circuit 17 writes Vdt into the first end of the driving circuit 10 under the control of the scanning signal.

Figure 9A:
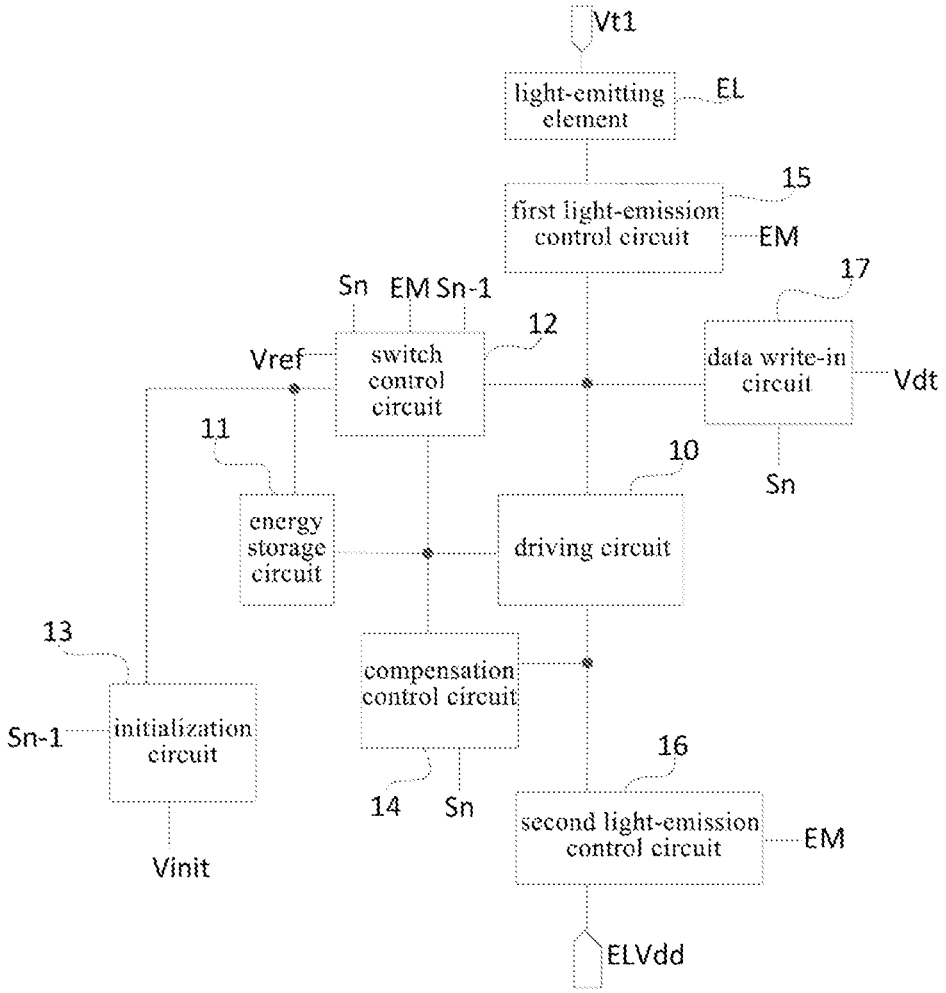
FIG. 9A is still yet another schematic view showing the pixel circuit according to one embodiment of the present disclosure.

As shown in FIG. 9A, on the basis of the pixel circuit in FIG. 7A, the pixel circuit in the embodiments of the present disclosure further includes a data write-in circuit 17 coupled to the scanning line Sn, the data line and the first end of the driving circuit 10, and configured to write the data voltage Vdt across the data line into the first end of the driving circuit 10 under the control of the scanning signal from the scanning line Sn.

Figure 9B:
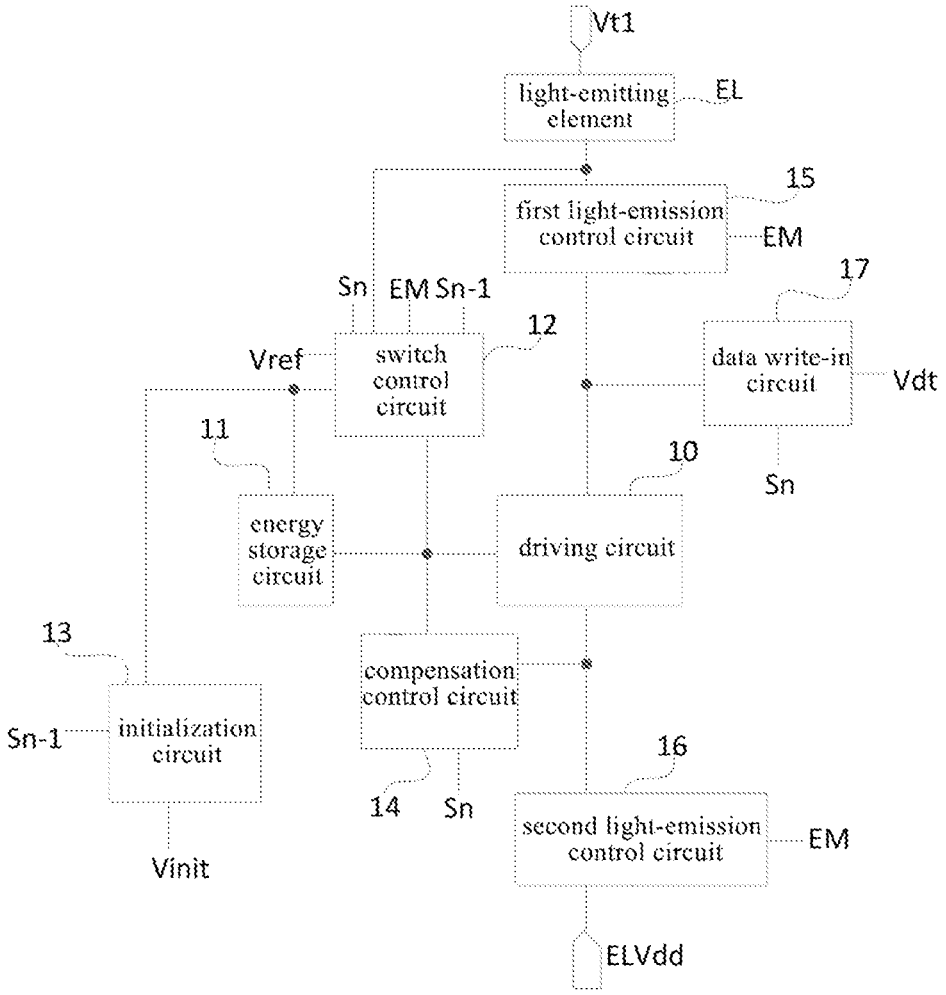
FIG. 9B is still yet another schematic view showing the pixel circuit according to one embodiment of the present disclosure.

As shown in FIG. 9B, on the basis of the pixel circuit in FIG. 7B, the pixel circuit in the embodiments of the present disclosure further includes a data write-in circuit 17 coupled to the scanning line Sn, the data line and the first end of the driving circuit 10, and configured to write the data voltage Vdt across the data line into the first end of the driving circuit 10 under the control of the scanning signal from the scanning line Sn.

At the light-emission stage, the data write-in circuit 17 writes Vdt into the first end of the driving circuit 10 under the control of the scanning signal.

To be specific, the data write-in circuit includes a data write-in transistor, a control electrode of which is coupled to the scanning line, a first electrode of which is coupled to the data line, and a second electrode of which is coupled to the first end of the driving circuit.

The pixel circuit will be described hereinafter in conjunction with four embodiments.

Figure 10:
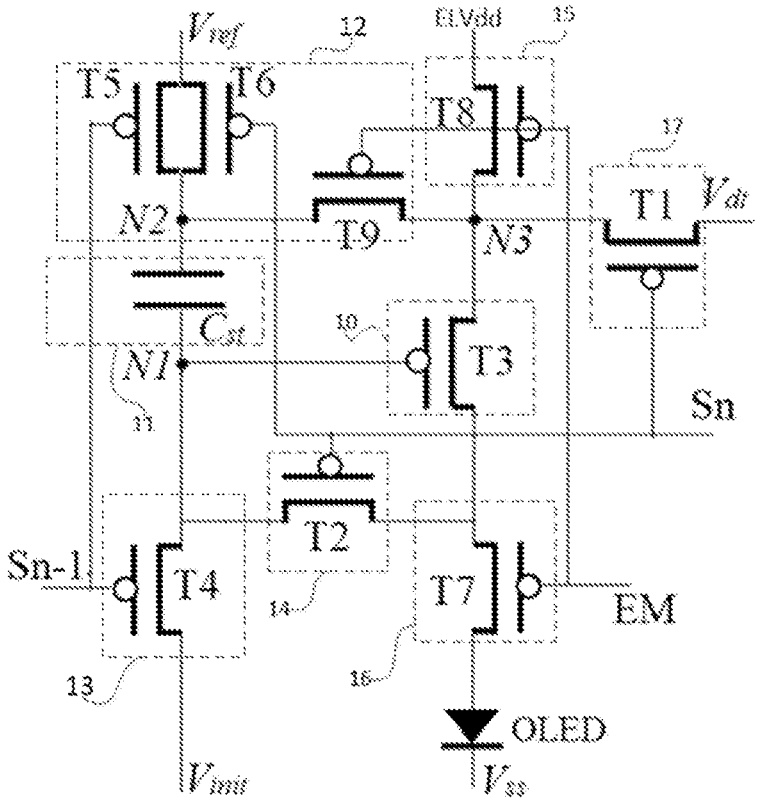
FIG. 10 is a circuit diagram of the pixel circuit according to a first embodiment of the present disclosure.

As shown in FIG. 10, the pixel circuit in a first embodiment of the present disclosure includes an OLED, a driving circuit 10, an energy storage circuit 11, a switch control circuit 12, an initialization circuit 13, a compensation control circuit 14, a first light-emission control circuit 15, a second light-emission control circuit 16 and a data write-in circuit 17.

The energy storage circuit 11 includes a storage capacitor Cst, the switch control circuit 12 includes a switch control transistor T9, a resetting transistor T5 and a voltage control transistor T6, the driving circuit 10 includes a driving transistor T3, the initialization circuit 13 includes an initialization transistor T4, the compensation control circuit includes a compensation control transistor T2, the first light-emission control circuit 15 includes a first light-emission control transistor T8, a second light-emission control circuit 16 includes a second light-emission control transistor T7, the energy storage circuit includes a storage capacitor Cst, and the data write-in circuit 17 includes a data write-in transistor T1.

A first end of the energy storage capacitor Cst is coupled to a gate electrode of the driving transistor T3, the gate electrode of T3 is coupled to a first node N1, a second end of Cst is coupled to a second node N2, and a source electrode of T3 is coupled to a third node N3.

A gate electrode of the switch control transistor T9 is coupled to the light-emission control line EM, a source electrode of the switch control transistor T9 is coupled to the second end of the storage capacitor Cst, and a drain electrode of the switch control transistor T9 is coupled to the source electrode of the driving transistor T3.

A gate electrode of the resetting transistor T5 is coupled to the resetting line Sn−1, a source electrode of the resetting transistor T5 is coupled to a reference voltage end, a drain electrode of the resetting transistor T5 is coupled to the second end of the storage capacitor Cst, and the reference voltage end is configured to provide a reference voltage Vref.

A gate electrode of the initialization transistor T4 is coupled to the resetting line Sn−1, a source electrode of the initialization transistor T4 is coupled to the first end of the storage capacitor Cst, a drain electrode of the initialization transistor T4 is coupled to an initialization voltage end, and the initialization voltage end is configured to provide an initialization voltage Vinit.

A gate electrode of the voltage control transistor T6 is coupled to the scanning line Sn, a source electrode of the voltage control transistor T6 is coupled to the reference voltage end, and a drain electrode of the voltage control transistor T6 is coupled to the second end of the storage capacitor Cst.

A gate electrode of the compensation control transistor T2 is coupled to the scanning line Sn, a source electrode of the compensation control transistor T2 is coupled to the gate electrode of the driving transistor T3, and a drain electrode of the compensation control transistor T2 is coupled to a drain electrode of the driving transistor T3.

A gate electrode of the first light-emission control transistor T8 is coupled to the light-emission control line EM, a source electrode of the first light-emission control transistor T8 is coupled to a power source voltage end ELVdd, a drain electrode of the first light-emission control transistor T8 is coupled to the source electrode of the driving transistor T3, and the power source voltage end ELVdd is configured to provide a power source voltage Vdd.

A gate electrode of the second light-emission control transistor T7 is coupled to the light-emission control line EM, a source electrode of the second light-emission control transistor T7 is coupled to the drain electrode of the driving transistor T3, a drain electrode of the second light-emission control transistor T7 is coupled to an anode of the OLED, and a cathode of the OLED receives a cathode voltage Vss.

A gate electrode of the data write-in transistor T1 is coupled to the scanning line Sn, a source electrode of the data write-in transistor T1 is coupled to the data line, a drain electrode of the data write-in transistor T1 is coupled to the source electrode of the driving transistor T3, and the data line is configured to provide a data voltage Vdt at a data write-in stage.

In the pixel circuit in FIG. 10, all the transistors are, but not limited to, p-type thin film transistors.

Figure 11:
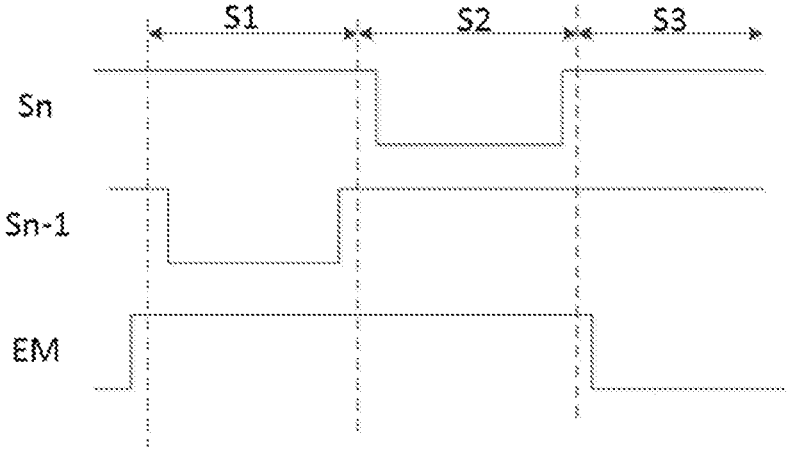
FIG. 11 is a sequence diagram of the pixel circuit according to the first embodiment of the present disclosure.

As shown in FIG. 11, the display period includes an initialization stage S1, a data write-in stage S2 and a light-emission stage S3 arranged sequentially.

Figure 12A:
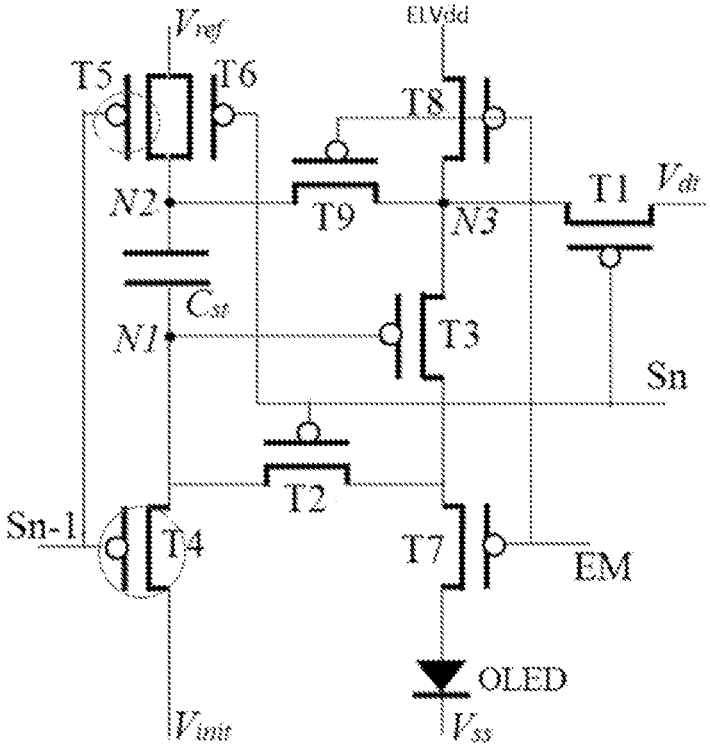
FIG. 12A is a schematic view showing an operating state of the pixel circuit at an initialization stage according to the first embodiment of the present disclosure.

At the initialization stage S1, Sn provides a high voltage signal, Sn−1 provides a low voltage signal, and EM provides a high voltage signal as shown in FIG. 12A, so as to turn on T4 and T5, thereby to write Vref into N2 and write Vinit into N1. At this time, T3 is turned on at the beginning of the data write-in stage S2.

Figure 12B:
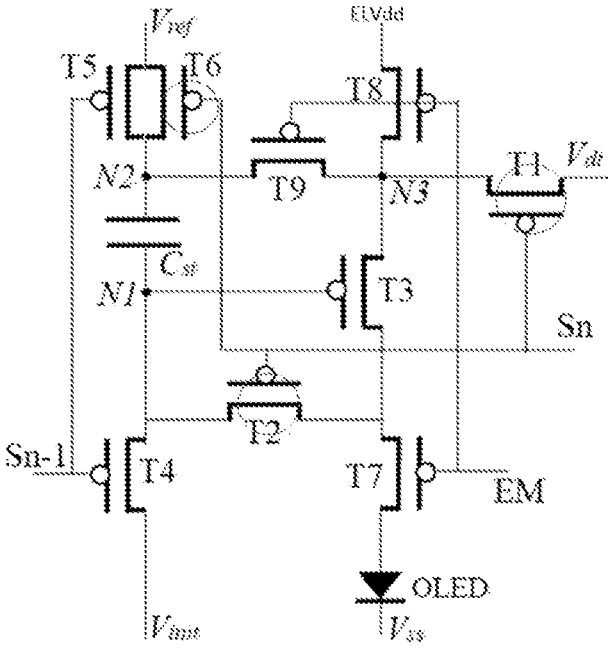
FIG. 12B is a schematic view showing the operating state of the pixel circuit at the data write-in stage according to the first embodiment of the present disclosure.

At the data write-in stage S2, Sn provides a low voltage signal, Sn−1 provides a high voltage signal, and EM provides a high voltage signal as shown in FIG. 12B, so as to turn off T4 and T5 and turn on T6, thereby to maintain a potential at N2 as Vref. T1 and T2 are turned on, and the data line provides the data voltage Vdt to N3. T3 is turned on, so as to charge Cst and pull up a potential at N1 until the potential at N1 is Vdt+Vth. At this time, T3 is turned off, and Cst is not charged, where Vth represents a threshold voltage of T3.

Figure 12C:
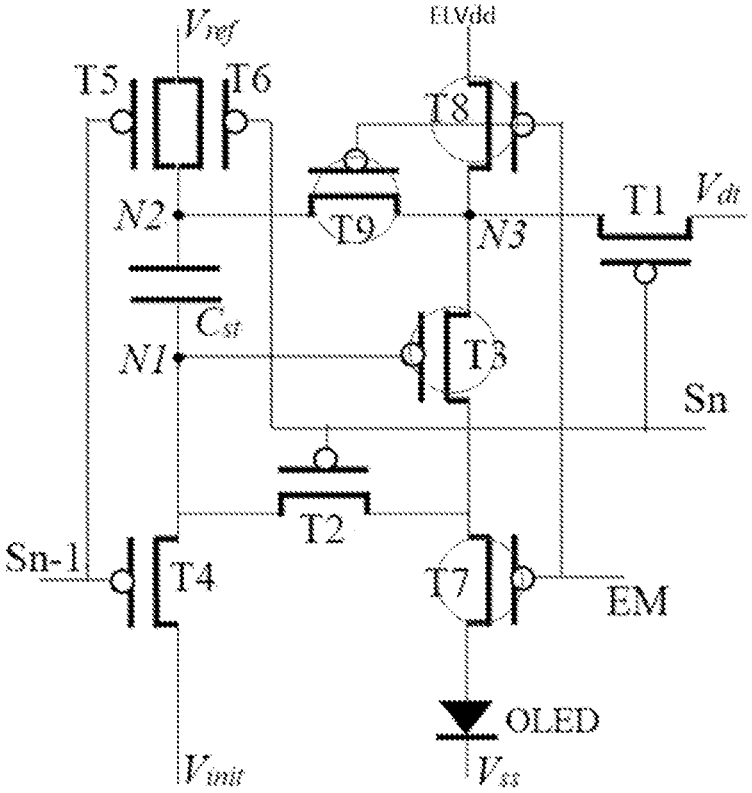
FIG. 12C is a schematic view showing the operating state of the pixel circuit at the light-emission stage according to the first embodiment of the present disclosure.

At the light-emission stage S3, Sn provides a high voltage signal, Sn−1 provides a high voltage signal, and EM provides a low voltage signal as shown in FIG. 12C, so as to turn on T8, T7 and T9, thereby to control N2 to be electrically coupled to N3 and enable a potential at N2 to change from Vref to Vdd. A voltage across Cst cannot jump, so the potential at N1 is changed to Vdt+Vth+Vdd−Vref. A gate-to-source voltage of T3 is Vdt+Vth-Vref, so T3 is turned on, so as to drive the OLED to emit light. A driving current Ioled flowing through T3 is calculated through an equation $Ioled=K(Vdt+Vth-Vref-Vth)^2=K(Vdt-Vref)^2$, where Vth represents the threshold voltage of T3. Based on the above, Ioled is irrelevant to the threshold voltage Vth of T3 as well as a drain-to-source voltage Vds of T8.

Figure 13:
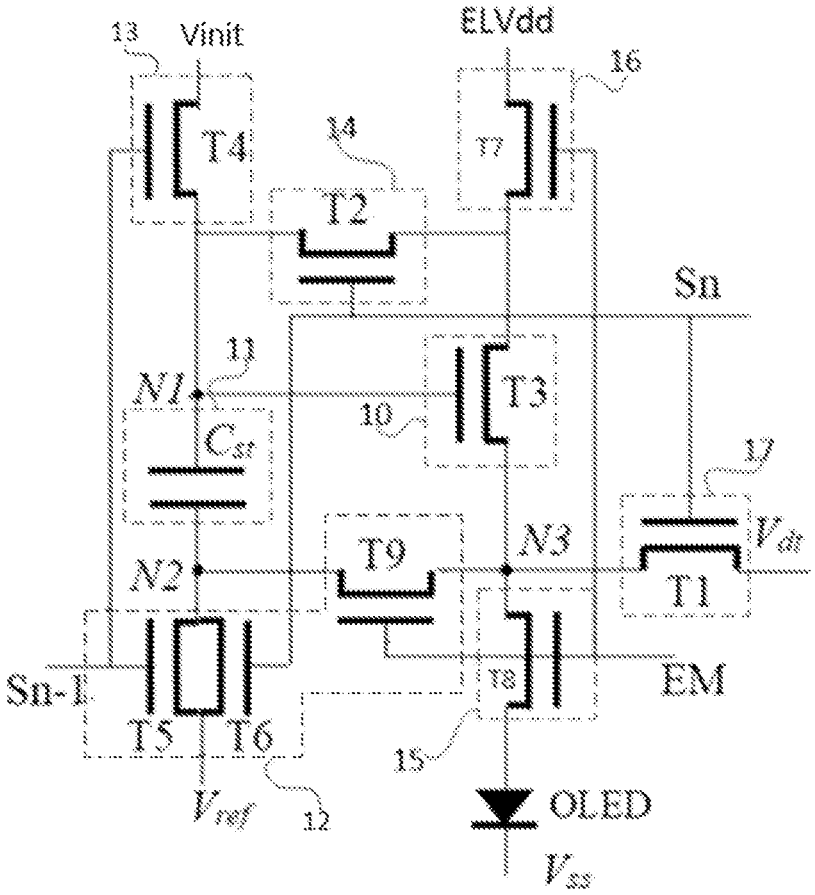
FIG. 13 is a circuit diagram of the pixel circuit according to a second embodiment of the present disclosure.

As shown in FIG. 13, the pixel circuit in a second embodiment of the present disclosure includes an OLED, a driving circuit 10, an energy storage circuit 11, a switch control circuit 12, an initialization circuit 13, a compensation control circuit 14, a first light-emission control circuit 15, a second light-emission control circuit 16 and a data write-in circuit 17.

The energy storage circuit 11 includes a storage capacitor Cst, the switch control circuit 12 includes a switch control transistor T9, a resetting transistor T5 and a voltage control transistor T6, the driving circuit 10 includes a driving transistor T3, the initialization circuit 13 includes an initialization transistor T4, the compensation control circuit includes a compensation control transistor T2, the first light-emission control circuit 15 includes a first light-emission control transistor T8, a second light-emission control circuit 16 includes a second light-emission control transistor T7, the energy storage circuit includes a storage capacitor Cst, and the data write-in circuit 17 includes a data write-in transistor T1.

A first end of the energy storage capacitor Cst is coupled to a gate electrode of the driving transistor T3, the gate electrode of T3 is coupled to a first node N1, a second end of Cst is coupled to a second node N2, and a source electrode of T3 is coupled to a third node N3.

A gate electrode of the switch control transistor T9 is coupled to the light-emission control line EM, a source electrode of the switch control transistor T9 is coupled to the second end of the storage capacitor Cst, and a drain electrode of the switch control transistor T9 is coupled to the source electrode of the driving transistor T3.

A gate electrode of the resetting transistor T5 is coupled to the resetting line Sn−1, a source electrode of the resetting transistor T5 is coupled to a reference voltage end, a drain electrode of the resetting transistor T5 is coupled to the second end of the storage capacitor Cst, and the reference voltage end is configured to provide a reference voltage Vref.

A gate electrode of the initialization transistor T4 is coupled to the resetting line Sn−1, a source electrode of the initialization transistor T4 is coupled to the first end of the storage capacitor Cst, a drain electrode of the initialization transistor T4 is coupled to an initialization voltage end, and the initialization voltage end is configured to provide an initialization voltage Vinit.

A gate electrode of the voltage control transistor T6 is coupled to the scanning line Sn, a source electrode of the voltage control transistor T6 is coupled to the reference voltage end, and a drain electrode of the voltage control transistor T6 is coupled to the second end of the storage capacitor Cst.

A gate electrode of the compensation control transistor T2 is coupled to the scanning line Sn, a source electrode of the compensation control transistor T2 is coupled to the gate electrode of the driving transistor T3, and a drain electrode of the compensation control transistor T2 is coupled to a drain electrode of the driving transistor T3.

A gate electrode of the first light-emission control transistor T8 is coupled to the light-emission control line EM, a drain electrode of the first light-emission control transistor T8 is coupled to the source electrode of the driving transistor T3, and a source electrode of the first light-emission control transistor T8 is coupled to an anode of the OLED.

A gate electrode of the second light-emission control transistor T7 is coupled to the light-emission control line EM, a drain electrode of the second light-emission control transistor T7 is coupled to a power source voltage end ELVdd, a source electrode of the second light-emission control transistor T7 is coupled to the drain electrode of the driving transistor T3, and the power source voltage end ELVdd is configured to provide a power source voltage Vdd. A cathode of the OLED receives a cathode voltage Vss.

A gate electrode of the data write-in transistor T1 is coupled to the scanning line Sn, a source electrode of the data write-in transistor T1 is coupled to the data line, a drain electrode of the data write-in transistor T1 is coupled to the source electrode of the driving transistor T3, and the data line is configured to provide a data voltage Vdt at a data write-in stage.

In the pixel circuit in the second embodiment of the present disclosure, all the transistors are, but not limited to, n-type thin film transistors.

Figure 14:
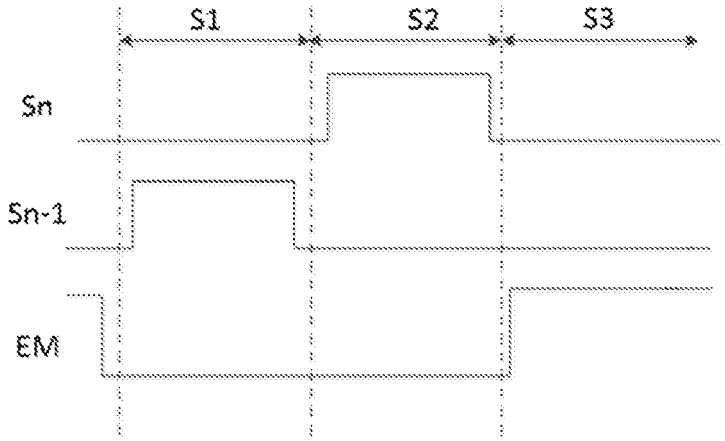
FIG. 14 is a sequence diagram of the pixel circuit according to the second embodiment of the present disclosure.

As shown in FIG. 14, the display period includes an initialization stage S1, a data write-in stage S2 and a light-emission stage S3 arranged sequentially.

Figure 15A:
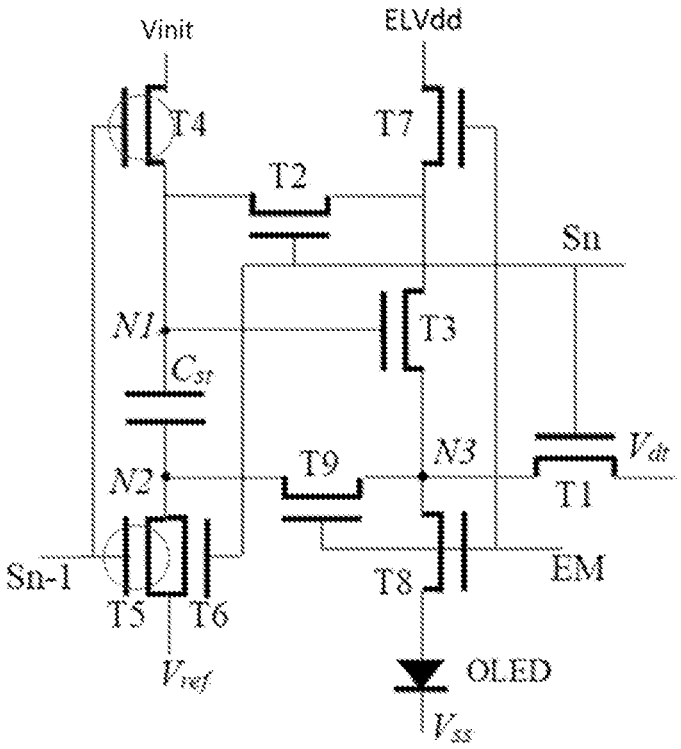
FIG. 15A is a schematic view showing the operating state of the pixel circuit at the initialization stage according to the second embodiment of the present disclosure.

At the initialization stage S1, Sn provides a low voltage signal, Sn−1 provides a high voltage signal, and EM provides a low voltage signal as shown in FIG. 15A, so as to turn on T4 and T5, thereby to write Vref into N2 and write Vinit into N1. At this time, T3 is turned on at the beginning of the data write-in stage S2.

Figure 15B:
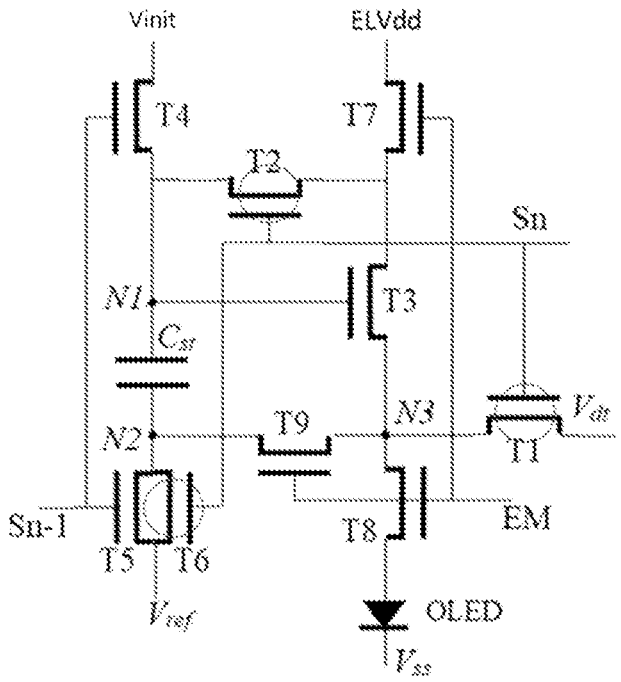
FIG. 15B is a schematic view showing the operating state of the pixel circuit at the data write-in stage according to the second embodiment of the present disclosure.

At the data write-in stage S2, Sn provides a high voltage signal, Sn−1 provides a low voltage signal, and EM provides a low voltage signal as shown in FIG. 15B, so as to turn off T4 and T5 and turn on T6, thereby to maintain a potential at N2 as Vref. T1 and T2 are turned on, and the data line provides the data voltage Vdt to N3. T3 is turned on, so as to charge Cst and pull down a potential at N1 until the potential at N1 is Vdt+Vth. At this time, T3 is turned off, and Cst is not charged, where Vth represents a threshold voltage of T3.

Figure 15C:
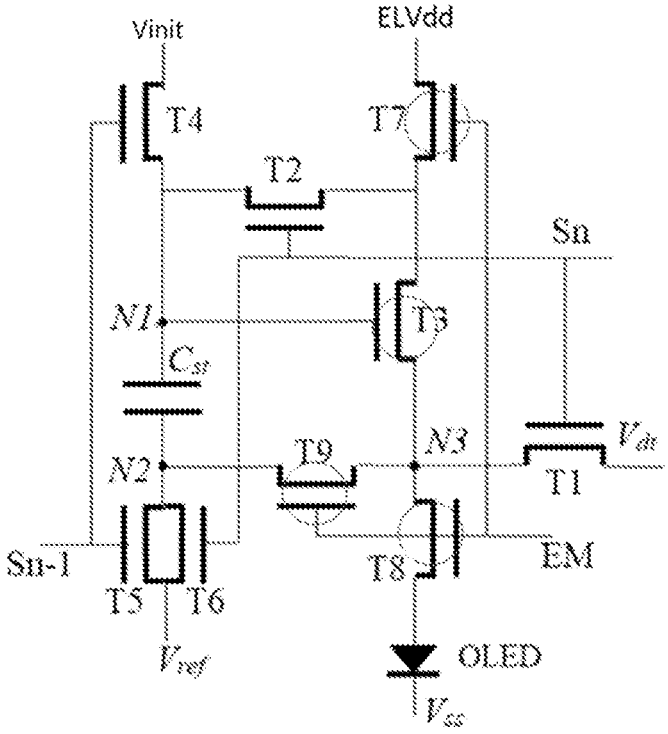
FIG. 15C is a schematic view showing the operating state of the pixel circuit at the light-emission stage according to the second embodiment of the present disclosure.

At the light-emission stage S3, Sn provides a low voltage signal, Sn−1 provides a low voltage signal, and EM provides a high voltage signal as shown in FIG. 15C, so as to turn on T8, T7 and T9, thereby to control N2 to be electrically coupled to N3 and enable a potential at N2 to jump from Vref to Vss. A voltage across Cst cannot jump, so the potential at N1 is changed to Vdt+Vth+Vss−Vref. A gate-to-source voltage of T3 is Vdt+Vth−Vref, so T3 is turned on, so as to drive the OLED to emit light. A driving current Ioled flowing through T3 is calculated through an equation $Ioled=K(Vdt+Vth-Vref-Vth)^2=K(Vdt-Vref)^2$, where Vth represents the threshold voltage of T3. Based on the above, Ioled is irrelevant to the threshold voltage Vth of T3 as well as a drain-to-source voltage Vds of T8.

Figure 16:
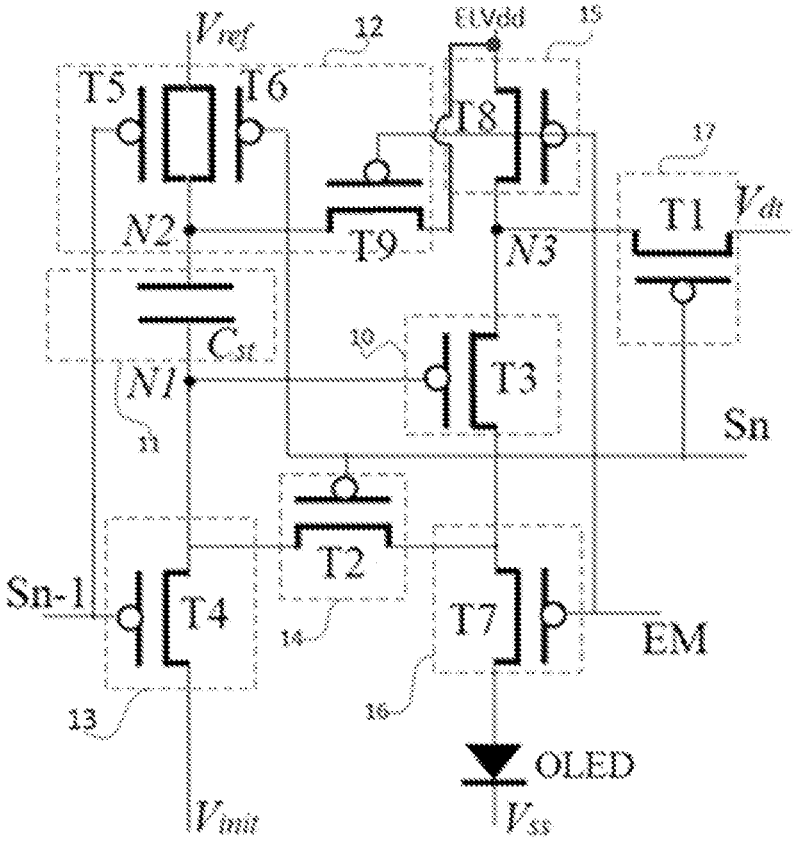
FIG. 16 is a circuit diagram of the pixel circuit according to a third embodiment of the present disclosure.

As shown in FIG. 16, the pixel circuit in a third embodiment of the present disclosure includes an OLED, a driving circuit 10, an energy storage circuit 11, a switch control circuit 12, an initialization circuit 13, a compensation control circuit 14, a first light-emission control circuit 15, a second light-emission control circuit 16 and a data write-in circuit 17.

The energy storage circuit 11 includes a storage capacitor Cst, the switch control circuit 12 includes a switch control transistor T9, a resetting transistor T5 and a voltage control transistor T6, the driving circuit 10 includes a driving transistor T3, the initialization circuit 13 includes an initialization transistor T4, the compensation control circuit includes a compensation control transistor T2, the first light-emission control circuit 15 includes a first light-emission control transistor T8, a second light-emission control circuit 16 includes a second light-emission control transistor T7, the energy storage circuit includes a storage capacitor Cst, and the data write-in circuit 17 includes a data write-in transistor T1.

A first end of the energy storage capacitor Cst is coupled to a gate electrode of the driving transistor T3, the gate electrode of T3 is coupled to a first node N1, a second end of Cst is coupled to a second node N2, and a source electrode of T3 is coupled to a third node N3.

A gate electrode of the switch control transistor T9 is coupled to the light-emission control line EM, a source electrode of the switch control transistor T9 is coupled to the second end of the storage capacitor Cst, and a drain electrode of the switch control transistor T9 is coupled to a power source voltage end ELVdd.

A gate electrode of the resetting transistor T5 is coupled to the resetting line Sn−1, a source electrode of the resetting transistor T5 is coupled to a reference voltage end, a drain electrode of the resetting transistor T5 is coupled to the second end of the storage capacitor Cst, and the reference voltage end is configured to provide a reference voltage Vref.

A gate electrode of the initialization transistor T4 is coupled to the resetting line Sn−1, a source electrode of the initialization transistor T4 is coupled to the first end of the storage capacitor Cst, a drain electrode of the initialization transistor T4 is coupled to an initialization voltage end, and the initialization voltage end is configured to provide an initialization voltage Vinit.

A gate electrode of the voltage control transistor T6 is coupled to the scanning line Sn, a source electrode of the voltage control transistor T6 is coupled to the reference voltage end, and a drain electrode of the voltage control transistor T6 is coupled to the second end of the storage capacitor Cst.

A gate electrode of the compensation control transistor T2 is coupled to the scanning line Sn, a source electrode of the compensation control transistor T2 is coupled to the gate electrode of the driving transistor T3, and a drain electrode of the compensation control transistor T2 is coupled to a drain electrode of the driving transistor T3.

A gate electrode of the first light-emission control transistor T8 is coupled to the light-emission control line EM, a source electrode of the first light-emission control transistor T8 is coupled to the power source voltage end ELVdd, a drain electrode of the first light-emission control transistor T8 is coupled to the source electrode of the driving transistor T3, and the power source voltage end ELVdd is configured to provide a power source voltage Vdd.

A gate electrode of the second light-emission control transistor T7 is coupled to the light-emission control line EM, a source electrode of the second light-emission control transistor T7 is coupled to the drain electrode of the driving transistor T3, a drain electrode of the second light-emission control transistor T7 is coupled to an anode of the OLED, and a cathode of the OLED receives a cathode voltage Vss.

A gate electrode of the data write-in transistor T1 is coupled to the scanning line Sn, a source electrode of the data write-in transistor T1 is coupled to the data line, a drain electrode of the data write-in transistor T1 is coupled to the source electrode of the driving transistor T3, and the data line is configured to provide a data voltage Vdt at a data write-in stage.

In the pixel circuit in FIG. 16, all the transistors are, but not limited to, p-type thin film transistors.

Figure 17:
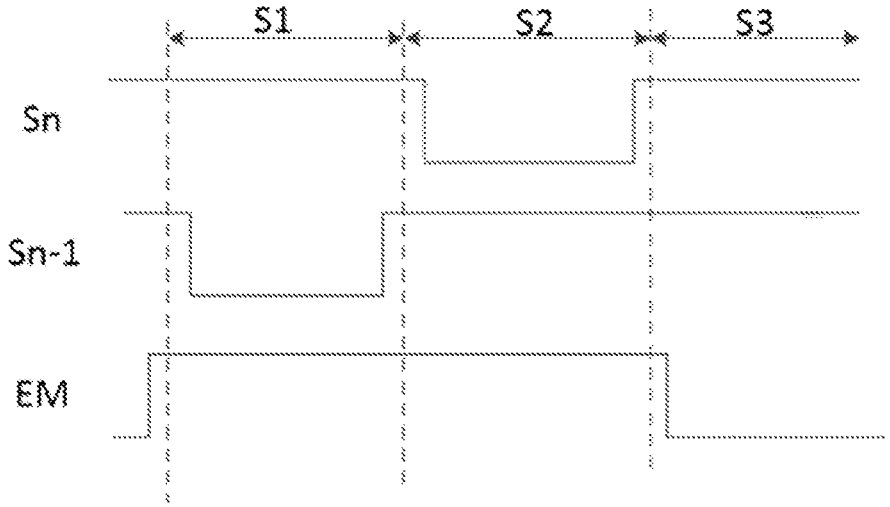
FIG. 17 is a sequence diagram of the pixel circuit according to the third embodiment of the present disclosure.

As shown in FIG. 17, the display period includes an initialization stage S1, a data write-in stage S2 and a light-emission stage S3 arranged sequentially.

At the initialization stage S1, Sn provides a high voltage signal, Sn−1 provides a low voltage signal, and EM provides a high voltage signal, so as to turn on T4 and T5, thereby to write Vref into N2 and write Vinit into N1. At this time, T3 is turned on at the beginning of the data write-in stage S2.

At the data write-in stage S2, Sn provides a low voltage signal, Sn−1 provides a high voltage signal, and EM provides a high voltage signal, so as to turn off T4 and T5 and turn on T6, thereby to maintain a potential at N2 as Vref. T1 and T2 are turned on, and the data line provides the data voltage Vdt to N3. T3 is turned on, so as to charge Cst and pull up a potential at N1 until the potential at N1 is Vdt+Vth. At this time, T3 is turned off, and Cst is not charged, where Vth represents a threshold voltage of T3.

At the light-emission stage S3, Sn provides a high voltage signal, Sn−1 provides a high voltage signal, and EM provides a low voltage signal, so as to turn on T8, T7 and T9, thereby to control N2 to be electrically coupled to N3 and enable a potential at N2 to change from Vref to Vdd. A voltage across Cst cannot jump, so the potential at N1 is changed to Vdt+Vth+Vdd−Vref. A gate-to-source voltage of T3 is Vdt+Vth−Vref, so T3 is turned on, so as to drive the OLED to emit light. A driving current Ioled flowing through T3 is calculated through an equation $Ioled=K(Vdt+Vth-Vref-Vth)^2=K(Vdt-Vref)^2$, where Vth represents the threshold voltage of T3. Based on the above, Ioled is irrelevant to the threshold voltage Vth of T3 as well as a drain-to-source voltage Vds of T8.

Figure 18:
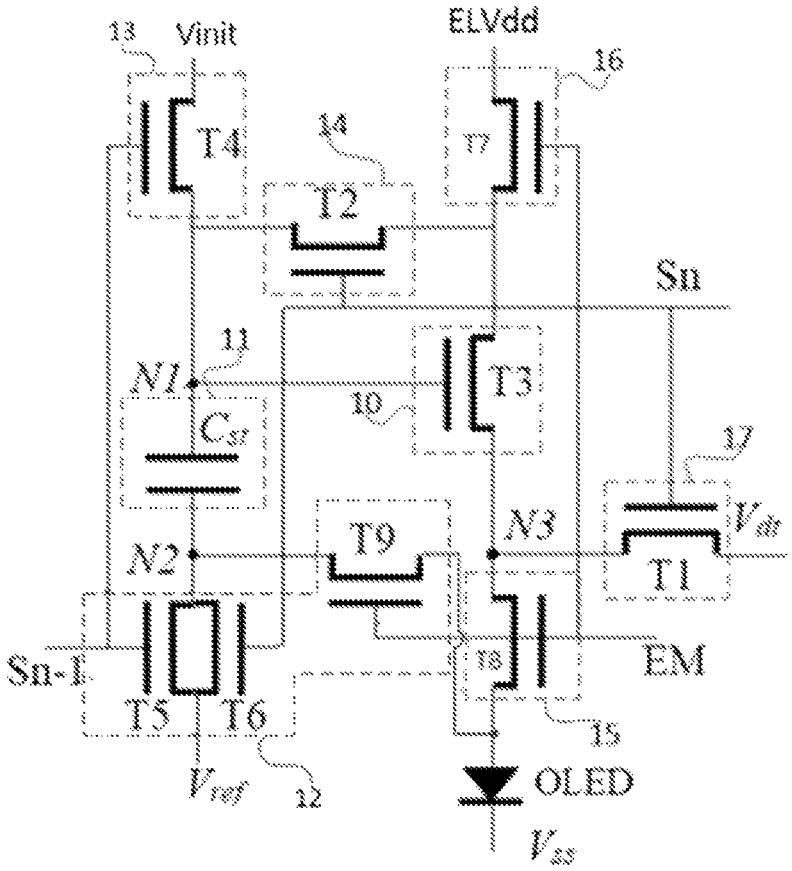
FIG. 18 is a circuit diagram of the pixel circuit according to a fourth embodiment of the present disclosure.

As shown in FIG. 18, the pixel circuit in a fourth embodiment of the present disclosure includes an OLED, a driving circuit 10, an energy storage circuit 11, a switch control circuit 12, an initialization circuit 13, a compensation control circuit 14, a first light-emission control circuit 15, a second light-emission control circuit 16 and a data write-in circuit 17.

The energy storage circuit 11 includes a storage capacitor Cst, the switch control circuit 12 includes a switch control transistor T9, a resetting transistor T5 and a voltage control transistor T6, the driving circuit 10 includes a driving transistor T3, the initialization circuit 13 includes an initialization transistor T4, the compensation control circuit includes a compensation control transistor T2, the first light-emission control circuit 15 includes a first light-emission control transistor T8, a second light-emission control circuit 16 includes a second light-emission control transistor T7, the energy storage circuit includes a storage capacitor Cst, and the data write-in circuit 17 includes a data write-in transistor T1.

A first end of the energy storage capacitor Cst is coupled to a gate electrode of the driving transistor T3, the gate electrode of T3 is coupled to a first node N1, a second end of Cst is coupled to a second node N2, and a source electrode of T3 is coupled to a third node N3.

A gate electrode of the switch control transistor T9 is coupled to the light-emission control line EM, a source electrode of the switch control transistor T9 is coupled to the second end of the storage capacitor Cst, and a drain electrode of the switch control transistor T9 is coupled to an anode of the OLED.

A gate electrode of the resetting transistor T5 is coupled to the resetting line Sn−1, a source electrode of the resetting transistor T5 is coupled to a reference voltage end, a drain electrode of the resetting transistor T5 is coupled to the second end of the storage capacitor Cst, and the reference voltage end is configured to provide a reference voltage Vref.

A gate electrode of the initialization transistor T4 is coupled to the resetting line Sn−1, a source electrode of the initialization transistor T4 is coupled to the first end of the storage capacitor Cst, a drain electrode of the initialization transistor T4 is coupled to an initialization voltage end, and the initialization voltage end is configured to provide an initialization voltage Vinit.

A gate electrode of the voltage control transistor T6 is coupled to the scanning line Sn, a source electrode of the voltage control transistor T6 is coupled to the reference voltage end, and a drain electrode of the voltage control transistor T6 is coupled to the second end of the storage capacitor Cst.

A gate electrode of the compensation control transistor T2 is coupled to the scanning line Sn, a source electrode of the compensation control transistor T2 is coupled to the gate electrode of the driving transistor T3, and a drain electrode of the compensation control transistor T2 is coupled to a drain electrode of the driving transistor T3.

A gate electrode of the first light-emission control transistor T8 is coupled to the light-emission control line EM, a drain electrode of the first light-emission control transistor T8 is coupled to the source electrode of the driving transistor T3, and a source electrode of the first light-emission control transistor T8 is coupled to an anode of the OLED.

A gate electrode of the second light-emission control transistor T7 is coupled to the light-emission control line EM, a drain electrode of the second light-emission control transistor T7 is coupled to a power source voltage end ELVdd, a source electrode of the second light-emission control transistor T7 is coupled to the drain electrode of the driving transistor T3, and the power source voltage end ELVdd is configured to provide a power source voltage Vdd. A cathode of the OLED receives a cathode voltage Vss.

A gate electrode of the data write-in transistor T1 is coupled to the scanning line Sn, a source electrode of the data write-in transistor T1 is coupled to the data line, a drain electrode of the data write-in transistor T1 is coupled to the source electrode of the driving transistor T3, and the data line is configured to provide a data voltage Vdt at a data write-in stage.

In the pixel circuit in the fourth embodiment of the present disclosure, all the transistors are, but not limited to, n-type thin film transistors.

Figure 19:
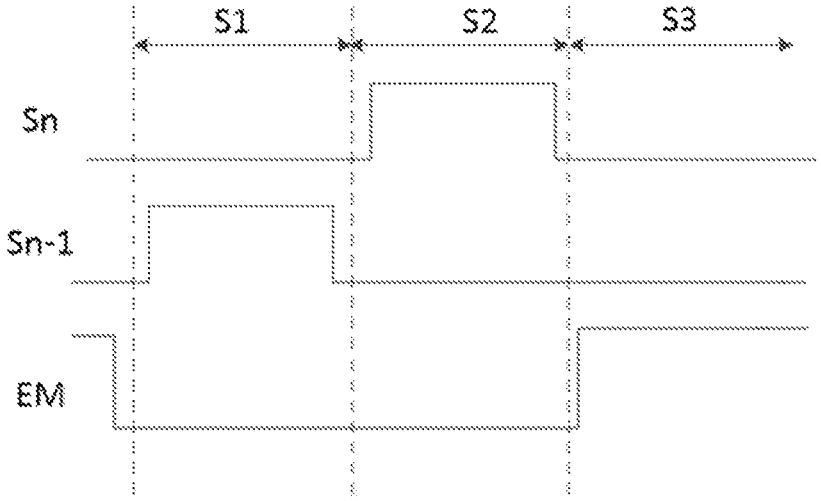
FIG. 19 is a sequence diagram of the pixel circuit according to the fourth embodiment of the present disclosure.

As shown in FIG. 19, the display period includes an initialization stage S1, a data write-in stage S2 and a light-emission stage S3 arranged sequentially.

At the initialization stage S1, Sn provides a low voltage signal, Sn−1 provides a high voltage signal, and EM provides a low voltage signal, so as to turn on T4 and T5, thereby to write Vref into N2 and write Vinit into N1. At this time, T3 is turned on at the beginning of the data write-in stage S2.

At the data write-in stage S2, Sn provides a high voltage signal, Sn−1 provides a low voltage signal, and EM provides a low voltage signal, so as to turn off T4 and T5 and turn on T6, thereby to maintain a potential at N2 as Vref. T1 and T2 are turned on, and the data line provides the data voltage Vdt to N3. T3 is turned on, so as to charge Cst and pull down a potential at N1 until the potential at N1 is Vdt+Vth. At this time, T3 is turned off, and Cst is not charged, where Vth represents a threshold voltage of T3.

At the light-emission stage S3, Sn provides a low voltage signal, Sn−1 provides a low voltage signal, and EM provides a high voltage signal, so as to turn on T8, T7 and T9, thereby to control N2 to be electrically coupled to N3 and enable a potential at N2 to jump from Vref to Vss. A voltage across Cst cannot jump, so the potential at N1 is changed to Vdt+Vth+Vss−Vref. A gate-to-source voltage of T3 is Vdt+Vth−Vref, so T3 is turned on, so as to drive the OLED to emit light. A driving current Ioled flowing through T3 is calculated through an equation $Ioled=K(Vdt+Vth-Vref-Vth)^2=K(Vdt-Vref)^2$, where Vth represents the threshold voltage of T3. Based on the above, Ioled is irrelevant to the threshold voltage Vth of T3 as well as a drain-to-source voltage Vds of T8.

The present disclosure further provides in some embodiments a pixel driving method for the above-mentioned pixel circuit. A display period includes a light-emission stage, and the pixel driving method includes, at the light-emission stage, controlling, by the switch control circuit, the second end of the energy storage circuit to be electrically coupled to the voltage application end or the first end of the driving circuit under the control of the light-emission control signal from the light-emission control line.

According to the pixel driving method in the embodiments of the present disclosure, at the light-emission stage, the switch control circuit is configured to control the second end of the energy storage circuit to be electrically coupled to voltage application end or the first end of the driving circuit under the control of the light-emission control signal from the light-emission control line, so as to prevent the generation of an additional voltage between the control end and the first end of the driving circuit at the light-emission stage. As a result, it is able to apply a voltage signal maintained in the energy storage circuit to between a gate electrode and a source electrode of a driving transistor of the driving circuit, prevent a gate-to-source voltage of the driving transistor from being adversely affected by a drain-to-source voltage of a light-emission control transistor, and prevent the occurrence of a non-uniform gate-to-source voltage of the driving transistor due to the non-uniform drain-to-source voltage, thereby to prevent the occurrence of such a defect as display non-uniformity.

During the implementation, the display period includes an initialization stage and a data write-in stage before the light-emission stage. The pixel driving method further includes: at the initialization stage, controlling, by the switch control circuit, the reference voltage end to be electrically coupled to the second end of the energy storage circuit under the control of the resetting signal from the resetting line; and at the data write-in stage, controlling, by the switch control circuit, the reference voltage end to be electrically coupled to the second end of the energy storage circuit under the control of the scanning signal from the scanning line.

In the embodiments of the present disclosure, the second end of the energy storage circuit is a reference voltage end, and the first end of the energy storage circuit is a signal end. At the initialization stage and the data write-in stage, the switch control circuit controls a potential at the second end of the energy storage circuit to be the reference voltage. In this way, it is able to provide a signal written by the first end of the energy storage circuit with a stable voltage value, thereby to initialize a potential at the control end of the driving circuit at the initialization stage and accurately write a data voltage into the control end of the driving circuit at the data write-in stage.

During the implementation, the display period includes an initialization stage and a data write-in stage before the light-emission stage, and the pixel driving method further includes, at the initialization stage and the data write-in stage, controlling, by the switch control circuit, the second end of the energy storage circuit to be electrically decoupled from the voltage application end or the first end of the driving circuit under the control of the light-emission control signal from the light-emission control line.

The present disclosure further provides in some embodiments a display device including the above-mentioned pixel circuit.

The display device in the embodiments of the present disclosure is any product or member having a display function, e.g., mobile phone, tablet computer, television, display, laptop computer, digital photo frame or navigator.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A pixel circuit, comprising a driving circuit, an energy storage circuit and a switch control circuit, wherein a first end of the energy storage circuit is coupled to a control end of the driving circuit, a second end of the energy storage circuit is coupled to a first end of the driving circuit via the switch control circuit, and the energy storage circuit is configured to store a voltage;

the switch control circuit is configured to control the second end of the energy storage circuit to be electrically coupled to a voltage application end or the first end of the driving circuit under the control of a light-emission control signal from a light-emission control line; and the driving circuit is configured to generate a driving current in accordance with a voltage between the control end and the first end of the driving circuit, the pixel circuit further comprises a light-emitting element, a first light-emission control circuit and a second light-emission control circuit, wherein the second end of the energy storage circuit is coupled to the first end of the driving circuit via the switch control circuit, the first light-emission control circuit is configured to control the first end of the driving circuit to be electrically coupled to a power source voltage end under the control the light-emission control signal, the second end of the driving circuit is coupled to the light-emitting element via the second light-emission control circuit, and the second light-emission control circuit is configured to control the second end of the driving circuit to be electrically coupled to the light-emitting element under the control of the light-emission control signal, wherein the driving circuit comprises a driving transistor, the first light-emission control circuit comprises a first light-emission control transistor, the second light-emission control circuit comprises a second light-emission control transistor, and the energy storage circuit comprises a storage capacitor;

a control electrode of the driving transistor is the control end of the driving circuit, a first electrode of the driving transistor is the first end of the driving circuit, and a second electrode of the driving transistor is the second end of the driving circuit;

a first end of the storage capacitor is the first end of the energy storage circuit, and a second end of the storage capacitor is the second end of the energy storage circuit;

a control electrode of the first light-emission control transistor is coupled to the light-emission control line, a first electrode of the first light-emission control transistor is coupled to the first electrode of the driving transistor, and a second electrode of the first light-emission control transistor is coupled to the power source voltage end; and a control electrode of the second light-emission control transistor is coupled to the light-emission control line, a first electrode of the second light-emission control transistor is coupled to the light-emitting element, and a second electrode of the second light-emission control transistor is coupled to the second electrode of the driving transistor.

2. The pixel circuit according to claim 1, further comprising a light-emitting element, wherein a driving transistor of the driving circuit is a p-type transistor, the first end of the driving circuit is coupled to a power source voltage end, and the voltage application end is the power-source voltage end; or the driving transistor is an n-type transistor, the first end of the driving circuit is coupled to a first electrode of the light-emitting element, a second electrode of the light-emitting element is coupled to a first voltage end, and the voltage application end is an end coupled to the first electrode of the light-emitting element.

3. The pixel circuit according to claim 1, wherein the switch control circuit is further configured to control a reference voltage end to be electrically coupled to the second end of the energy storage circuit under the control of a resetting signal from a resetting line or a scanning signal from a scanning line, and the reference voltage end is configured to provide a reference voltage.

4. The pixel circuit according to claim 1, wherein the switch control circuit comprises a switch control transistor, a control electrode of the switch control transistor is coupled to the light-emission control line, a first electrode of the switch control transistor is coupled to the second end of the energy storage circuit, and a second electrode of the switch control transistor is coupled to the first end of the driving circuit.

5. The pixel circuit according to claim 3, wherein the switch control circuit further comprises a resetting transistor and a voltage control transistor;

a control electrode of the resetting transistor is coupled to the resetting line, a first electrode of the resetting transistor is coupled to the reference voltage end, and a second electrode of the resetting transistor is coupled to the second end of the energy storage circuit; and a control electrode of the voltage control transistor is coupled to the scanning line, a first electrode of the voltage control transistor is coupled to the reference voltage end, and a second electrode of the voltage control transistor is coupled to the second end of the energy storage circuit.

6. The pixel circuit according to claim 1, further comprising an initialization circuit configured to write an initialization voltage from an initialization voltage end into the first end of the energy storage circuit under the control of the resetting signal from the resetting line.

7. The pixel circuit according to claim 6, wherein the initialization circuit comprises an initialization transistor, a control electrode of the initialization transistor is coupled to the resetting line, a first electrode of the initialization transistor is coupled to the first end of the energy storage circuit, and a second electrode of the initialization transistor is coupled to the initialization voltage end.

8. The pixel circuit according to claim 1, further comprising a compensation control circuit configured to control the control end of the driving circuit to be electrically coupled to the second end of the driving circuit under the control of the scanning signal from the scanning line.

9. The pixel circuit according to claim 8, wherein the compensation control circuit comprises a compensation control transistor, a control electrode of the compensation control transistor is coupled to the scanning line, a first electrode of the compensation control transistor is coupled to the control end of the driving circuit, and a second electrode of the compensation control transistor is coupled to the second end of the driving circuit.

10. The pixel circuit according to claim 1, wherein the voltage application end is a power source voltage end, and the pixel circuit further comprises a light-emitting element, a first light-emission control circuit and a second light-emission control circuit; wherein a second end of the energy storage circuit is coupled to the power source voltage end via the switch control circuit, the first light-emission control circuit is configured to control the first end of the driving circuit to be electrically coupled to the power source voltage end under the control of the light-emission control signal, the second end of the driving circuit is coupled to the light-emitting element via the second light-emission control circuit, and the second light-emission control circuit is configured to control the second end of the driving circuit to be electrically coupled to the light-emitting element under the control of the light-emission control signal.

11. The pixel circuit according to claim 1, further comprising a light-emitting element, a first light-emission control circuit and a second light-emission control circuit, wherein the second end of the energy storage circuit is coupled to the first end of the driving circuit via the switch control circuit, the first end of the driving circuit is coupled to the light-emitting element via the first light-emission control circuit, the first light-emission control circuit is configured to control the first end of the driving circuit to be electrically coupled to the light-emitting element under the control the light-emission control signal, and the second light-emission control circuit is configured to control the second end of the driving circuit to be electrically coupled to the power source voltage end under the control of the light-emission control signal.

12. The pixel circuit according to claim 1, further comprising a light-emitting element, a first light-emission control circuit and a second light-emission control circuit, wherein the voltage application end is an end coupled to a first electrode of the light-emitting element, the second end of the energy storage circuit is coupled to the voltage application end via the switch control circuit, a second electrode of the light-emitting element is coupled to a first voltage end, the first end of the driving circuit is coupled to the light-emitting element via the first light-emission control circuit, the first light-emission control circuit is configured to control the first end of the driving circuit to be electrically coupled to the light-emitting element under the control of the light-emission control signal, and the second light-emission control circuit is configured to control the second end of the driving circuit to be electrically coupled to the power source voltage end under the control of the light-emission control signal.

13. The pixel circuit according to claim 11, wherein the driving circuit comprises a driving transistor, the first light-emission control circuit comprises a first light-emission control transistor, the second light-emission control circuit comprises a second light-emission control transistor, and the energy storage circuit comprises a storage capacitor;

a control electrode of the driving transistor is the control end of the driving circuit, a first electrode of the driving transistor is the first end of the driving circuit, and a second electrode of the driving transistor is the second end of the driving circuit;

a first end of the storage capacitor is the first end of the energy storage circuit, and a second end of the storage capacitor is the second end of the energy storage circuit;

a control electrode of the first light-emission control transistor is coupled to the light-emission control line, a first electrode of the first light-emission control transistor is coupled to the first electrode of the driving transistor, and a second electrode of the first light-emission control transistor is coupled to the light-emitting element; and a control electrode of the second light-emission control transistor is coupled to the light-emission control line, a first electrode of the second light-emission control transistor is coupled to the power source voltage end, and a second electrode of the second light-emission control transistor is coupled to the second electrode of the driving transistor.

14. The pixel circuit according to claim 1, further comprising a data write-in circuit configured to write a data voltage across a data line into the first end of the driving circuit under the control of the scanning signal from the scanning line.

15. The pixel circuit according to claim 14, wherein the data write-in circuit comprises a data write-in transistor, a control electrode of the data write-in transistor is coupled to the scanning line, a first electrode of the data write-in transistor is coupled to the data line, and a second electrode of the data write-in transistor is coupled to the first end of the driving circuit.

16. A pixel driving method for the pixel circuit according to claim 1, wherein a display period comprises a light-emission stage, and the pixel driving method comprises, at the light-emission stage, controlling, by the switch control circuit, the second end of the energy storage circuit to be electrically coupled to the voltage application end or the first end of the driving circuit under the control of the light-emission control signal from the light-emission control line.

17. The pixel diving method according to claim 16, wherein the display period comprises an initialization stage and a data write-in stage before the light-emission stage, wherein the pixel driving method further comprises:

at the initialization stage, controlling, by the switch control circuit, the reference voltage end to be electrically coupled to the second end of the energy storage circuit under the control of the resetting signal from the resetting line; and at the data write-in stage, controlling, by the switch control circuit, the reference voltage end to be electrically coupled to the second end of the energy storage circuit under the control of the scanning signal from the scanning line; or wherein the display period comprises an initialization stage and a data write-in stage before the light-emission stage, and the pixel driving method further comprises:

at the initialization stage and the data write-in stage, controlling, by the switch control circuit, the second end of the energy storage circuit to be electrically decoupled from the voltage application end or the first end of the driving circuit under the control of the light-emission control signal from the light-emission control line.

18. A display device, comprising the pixel circuit according to claim 1.

19. A pixel circuit, comprising a driving circuit, an energy storage circuit and a switch control circuit, wherein a first end of the energy storage circuit is coupled to a control end of the driving circuit, a second end of the energy storage circuit is coupled to a first end of the driving circuit via the switch control circuit, and the energy storage circuit is configured to store a voltage;

the switch control circuit is configured to control the second end of the energy storage circuit to be electrically coupled to a voltage application end or the first end of the driving circuit under the control of a light-emission control signal from a light-emission control line; and the driving circuit is configured to generate a driving current in accordance with a voltage between the control end and the first end of the driving circuit, the pixel circuit further includes a light-emitting element, a first light-emission control circuit and a second light-emission control circuit, wherein the second end of the energy storage circuit is coupled to the first end of the driving circuit via the switch control circuit, the first end of the driving circuit is coupled to the light-emitting element via the first light-emission control circuit, the first light-emission control circuit is configured to control the first end of the driving circuit to be electrically coupled to the light-emitting element under the control the light-emission control signal, and the second light-emission control circuit is configured to control the second end of the driving circuit to be electrically coupled to the power source voltage end under the control of the light-emission control signal, wherein the driving circuit comprises a driving transistor, the first light-emission control circuit comprises a first light-emission control transistor, the second light-emission control circuit comprises a second light-emission control transistor, and the energy storage circuit comprises a storage capacitor;

a control electrode of the driving transistor is the control end of the driving circuit, a first electrode of the driving transistor is the first end of the driving circuit, and a second electrode of the driving transistor is the second end of the driving circuit;

a first end of the storage capacitor is the first end of the energy storage circuit, and a second end of the storage capacitor is the second end of the energy storage circuit;

a control electrode of the first light-emission control transistor is coupled to the light-emission control line, a first electrode of the first light-emission control transistor is coupled to the first electrode of the driving transistor, and a second electrode of the first light-emission control transistor is coupled to the light-emitting element; and a control electrode of the second light-emission control transistor is coupled to the light-emission control line, a first electrode of the second light-emission control transistor is coupled to the power source voltage end, and a second electrode of the second light-emission control transistor is coupled to the second electrode of the driving transistor.

* * * * *